US007646999B2

(12) United States Patent
Tanaka

(10) Patent No.: US 7,646,999 B2
(45) Date of Patent: Jan. 12, 2010

(54) IMAGE FORMING APPARATUS AND CONTROL METHOD FOR PROCESSING PRINT REQUESTS IN A PRINT QUEUE

(75) Inventor: Hideo Tanaka, Ohsaka-fu (JP)

(73) Assignee: Ricoh Company, Ltd., Tokyo (JP)

( * ) Notice: Subject to any disclaimer, the term of this patent is extended or adjusted under 35 U.S.C. 154(b) by 142 days.

(21) Appl. No.: 11/520,702

(22) Filed: Sep. 14, 2006

(65) Prior Publication Data

US 2007/0071477 A1 Mar. 29, 2007

(30) Foreign Application Priority Data

Sep. 15, 2005 (JP) ..... 2005-269133

(51) Int. Cl.
*G03G 15/00* (2006.01)

(52) U.S. Cl. ..... 399/82

(58) Field of Classification Search ..... 399/8, 399/13, 23, 82

See application file for complete search history.

(56) References Cited

U.S. PATENT DOCUMENTS

| | | | | |
|---|---|---|---|---|
| 6,700,675 | B1 * | 3/2004 | Yamamoto | 399/82 X |
| 2003/0072020 | A1 * | 4/2003 | Mitsudomi et al. | 358/1.13 |
| 2003/0076525 | A1 * | 4/2003 | Hikawa | 358/1.14 |

FOREIGN PATENT DOCUMENTS

| | | |
|---|---|---|
| JP | 2005-161748 | 6/2005 |

* cited by examiner

*Primary Examiner*—Sandra L Brase
(74) *Attorney, Agent, or Firm*—Oblon, Spivak, McClelland, Maier & Neustadt, L.L.P.

(57) ABSTRACT

An image forming apparatus, and a control method and program for same, whereby processing efficiency can be improved by permitting processing in respect of other print requests, even when paper has not been loaded in a manual paper supply unit after a manual print request has been made. When a print request relating to a prescribed paper is received, processing in respect of other print requests is permitted until it is detected that the prescribed paper has been loaded.

24 Claims, 27 Drawing Sheets

<PLEASE SELECT ID TO PRINT>
1. ID = 6

<PLEASE SELECT ID TO PRINT>
2. ID = 10

IMAGE FORMING APPARATUS AND CONTROL METHOD FOR PROCESSING PRINT REQUESTS IN A PRINT QUEUE

BACKGROUND OF THE INVENTION

1. Field of the Invention

The present invention relates to an image forming apparatus which executes corresponding image formation processing in accordance with an image formation request, a control method of same, and a program which causes a computer to implement this control method. More specifically, the present invention relates to an image forming apparatus, and a control method and program for same, whereby, when a manual paper supply unit is connected, image formation is performed preferentially by selecting paper supply from the manual paper supply unit, and furthermore, whereby processing for other print requests is still permitted, even if paper has not been set in the manual paper supply unit after a manual print request has been made.

2. Description of the Background Art

Conventionally, an image forming apparatus which is fitted with copy functions, printer functions, facsimile functions, or the like, often comprises, in addition to a plurality of automatic paper supply units which are generally fitted with paper supply trays or cassettes, a manual paper supply unit in which paper of a desired size can be set. Normally, the manual paper supply unit is provided in order that types of paper which lie outside the specifications of the automatic paper supply units can be supplied and introduced into the main body of the apparatus, in special circumstances. At present, there has been no variation in the basic position with respect to manual paper supply units of this kind.

However, in recent years, the requirement for manual paper supply units has gradually increased, and there have been proposals for technology which not only is able to handle a wide range of paper types, but also allows a plurality of sheets of paper to be supplied continuously from the manual paper supply unit, in a similar fashion to an automatic paper supply unit. In an image forming apparatus fitted with a manual paper supply unit which is capable of supplying a plurality of sheets of paper continuously in this way, if an input image is to be formed onto paper set in a manual paper supply unit, then it is possible to supply a plurality of sheets of paper in a continuous fashion, by specifying the paper size set in the manual paper supply unit, and designating the manual paper supply unit as the paper source.

In an image forming apparatus fitted with a manual paper supply unit of this kind, if the user only specifies the paper size loaded into the manual paper supply unit and has not designated the paper supply unit that is to be the paper source, then the image forming apparatus will execute formation processing for the input image by supplying paper from a paper supply unit that was not intended by the user.

Therefore, in the technology disclosed in Japanese Patent Application Publication No. 2001-235979, the user is prevented from forgetting to make settings, and hence print processing using an unintended paper supply unit is avoided, in addition to which, it is possible to change the paper source rapidly when the user wishes to supply paper from a paper supply unit other than the manual paper supply unit. Therefore, image formation processing using paper supplied from a paper supply unit that was not intended by the user is prevented.

On the other hand, if paper has not been set in the manual paper supply unit, but image formation processing is implemented which specifies the paper size and designates the manual paper supply unit as the paper source, then a problem arises in that processing cannot be continued by automatically switching to another paper supply unit fitted with a paper supply tray loaded with paper of the same size.

In the image forming apparatus disclosed in Japanese Patent Application Publication No. 2001-235979 described above, if the paper size loaded in the manual paper supply unit has been specified for image formation processing, then it is judged whether or not the manual paper supply unit can be designated as the paper source, and if it can be designated as such, then control is implemented to designate the manual paper supply unit as the paper source, and when the designation is completed, a paper selection screen which allows confirmation or changing of the setting of the manual paper supply unit as the paper source, is displayed on an operating section. Thereby, the user is prevented from forgetting to make settings, and the occurrence of image formation processing using an unintended paper supply unit can be prevented.

However, the plurality of operations required, such as the confirmation or changing of the paper loaded in the manual paper supply unit, the setting of the paper size loaded in the manual paper supply unit, the designation of the manual paper supply unit, and the like, create interruptions which cause the image formation process to lose continuity. This has an effect on the formation processing relating to other images and causes a decline in the overall throughput of the image forming apparatus.

Furthermore, since a large amount of operating time is required for paper supply using the manual paper supply unit, then in an image forming apparatus which processes data transferred from a terminal apparatus, such as a personal computer, time-outs occur frequently in the personal computer, or other terminal apparatus. Therefore, data retransmissions occur, increasing the unnecessary communications traffic, placing an extra burden on the network, and adversely affecting other communications operations.

Moreover, if the manual paper supply unit is used frequently, then the time required for operation, and the subsequent interruptions caused to the image processing, will affect the processing of the image forming system and hence affect the overall throughput of the processing.

Furthermore, if the paper loaded in the manual paper supply unit runs out, then the apparatus does not switch automatically to another paper supply unit which is fitted with a paper supply device loaded with paper of the same paper size. Therefore, processing has to wait until the specified paper is loaded, and this means that the operation of the image forming apparatus is halted. Consequently, there remains the problem of negative effects on operational efficiency.

On the other hand, if manual printing is carried out using an image forming apparatus connected to the computer terminals of a plurality of users by means of a LAN, or the like, then firstly, the user sets the prescribed paper in the manual paper supply unit of the image forming apparatus. The user then has to input a corresponding print request at his or her own computer terminal. When the print processing has been completed by the image forming apparatus, the user goes to the image forming apparatus again in order to obtain the printed paper. In this case, the user has to make two round trips between his or her own computer terminal and the image forming apparatus, until he or she can obtain the printed paper. Therefore, in cases where there is a large distance separating the user's computer terminal and the image forming apparatus, there is a risk that the working efficiency of the user will fall.

On the other hand, there is also a method in which the user inputs a corresponding print request at his or her own computer terminal, before loading the prescribed paper in the manual paper supply unit of the image forming apparatus. In this case, the image forming apparatus automatically detects that paper has not been loaded in the corresponding manual paper supply unit, and it outputs an appropriate message and then enters a "standby state". When the image forming apparatus has entered a standby state of this kind, it will not permit processing of any other print requests, until paper has been loaded in the manual paper supply unit and the processing for the corresponding print request has been completed. As a result, there is a risk that the processing efficiency of the image forming apparatus will fall.

SUMMARY OF THE INVENTION

It is an object of the present invention to provide an image forming apparatus, and a control method and program for same, whereby the print results intended by the user can be obtained at all times, by preventing the user from forgetting to set paper information for printing (paper size, paper orientation, etc.) and preventing supply of unintended paper, and whereby the performance of the image forming apparatus is stabilized, system throughput is greatly improved, CS (customer satisfaction) is enhanced, and low-cost operation can be achieved.

A further object of the present invention is to provide an image forming apparatus, and a control method and program for same, whereby processing efficiency can be improved by permitting processing for other print requests, even if paper has not been loaded in the manual paper supply unit after a manual paper supply request has been made.

In an aspect of the present invention, an image forming apparatus forms an image on a prescribed image recording medium in accordance with an image formation request. The image forming apparatus comprises an image recording medium detection device which detects that a prescribed image recording medium has been loaded into the image forming apparatus; and a device, when an image formation request relating to a prescribed image recording medium is received, permits processing in respect of another image formation request, until detected by the image recording medium detection device that the prescribed image recording medium has been loaded.

In another aspect of the present invention, a method for controlling an image forming apparatus forms an image on a prescribed image recording medium in accordance with an image formation request. The method comprises an image recording medium detection step of detecting that a prescribed image recording medium has been loaded into the image forming apparatus; and a step which, when an image formation request relating to a prescribed image recording medium is received, permits processing in respect of another image formation request, until detected by the image recording medium detection step that the prescribed image recording medium has been loaded.

In another aspect of the present invention, a program controls, by a computer, an image forming apparatus which forms an image on a prescribed image recording medium in accordance with an image formation request. The program comprises commands for causing the computer to perform: an image recording medium detection step of detecting that a prescribed image recording medium has been loaded into the image forming apparatus; and a step which, when an image formation request relating to a prescribed image recording medium is received, permits processing in respect of another image formation request, until detected in the image recording medium detection step that the prescribed image recording medium has been loaded.

BRIEF DESCRIPTION OF THE DRAWINGS

The above and other objects, features and advantages of the present invention will become more apparent from the following detailed description taken with the accompanying drawings, in which.

DESCRIPTION OF THE PREFERRED EMBODIMENTS

Figure 1:
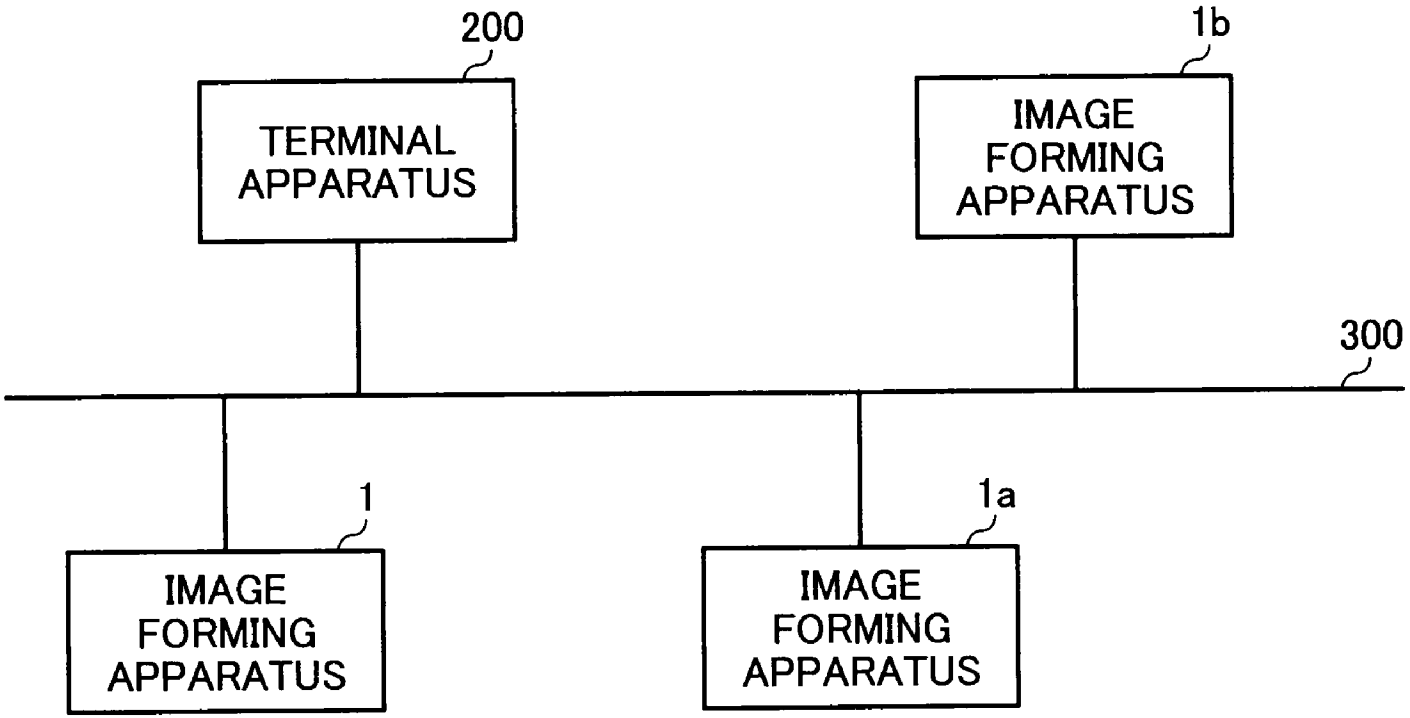
FIG. 1 is a block diagram showing the general composition of an image forming system relating to a first embodiment of the present invention.

Preferred embodiments of the present invention will be described hereinafter. It is to be noted that the reference numerals used in each embodiment are independent of the reference numerals of the other embodiments, i.e., the same reference numerals do not always designate the same structural elements.

First Embodiment

Below, a first embodiment of the present invention will be described in detail with respect to the drawings.

FIG. 1 shows the general composition of an image forming system relating to the present embodiment. In FIG. 1, the image forming system comprises one or more image forming apparatuses 1, a local area network (hereinafter, LAN) 300, a terminal device 200, and the like.

The functions of the respective devices described in (A1) to (A10) below are performed by means of hardware and software (programs) including the CPU (described below) in the image forming apparatus 1.

(A1) A function for detecting whether or not paper has been loaded in a paper supply tray attached to a paper supply unit (A2) A function for previously specifying a paper supply unit to be used preferentially for paper supply (A3) A function for acquiring paper information (paper size, paper orientation, etc.) of a paper supply tray attached to the preferential paper supply unit designated by the function (A2)

(A4) A function for specifying the paper information for image data by means of the paper information acquired by the function (A35), if paper information is not appended to the input image data, and for specifying the paper information for image data by means of the appended paper information, if paper information is appended to the image data;

(A5) A function for searching for and identifying a paper supply unit fitted with a paper supply tray loaded with paper having the paper information specified by the function (A4), taking the manual paper supply tray as the first search position when a manual paper supply tray is attached, and taking the preferential paper supply unit as the first search position when a manual paper supply tray is not attached;

(A6) A function for setting paper information for the paper loaded in the manual paper supply tray;

(A7) A function for switching the paper information to the paper information acquired by the function (A3), when a manual paper supply unit is attached;

(A8) A function for supplying paper from a paper supply tray attached to the paper supply unit identified by the function (A5);

(A9) A function for receiving image data via a network; and (A10) A function for forming the input image data on paper supplied from the paper supply tray attached to the identified paper supply unit.

In the present embodiment, all of the respective functions described above are provided by means of hardware and software in the image forming apparatus 1, but this is not necessarily so, and it is of course also possible to provide the respective functions selectively, according to requirements. The image forming apparatuses 1, 1*a*, 1*b* and the terminal apparatus 200 are connected to a LAN 300, and the LAN 300 is connected to an external network via a router apparatus (not illustrated).

Figure 2:
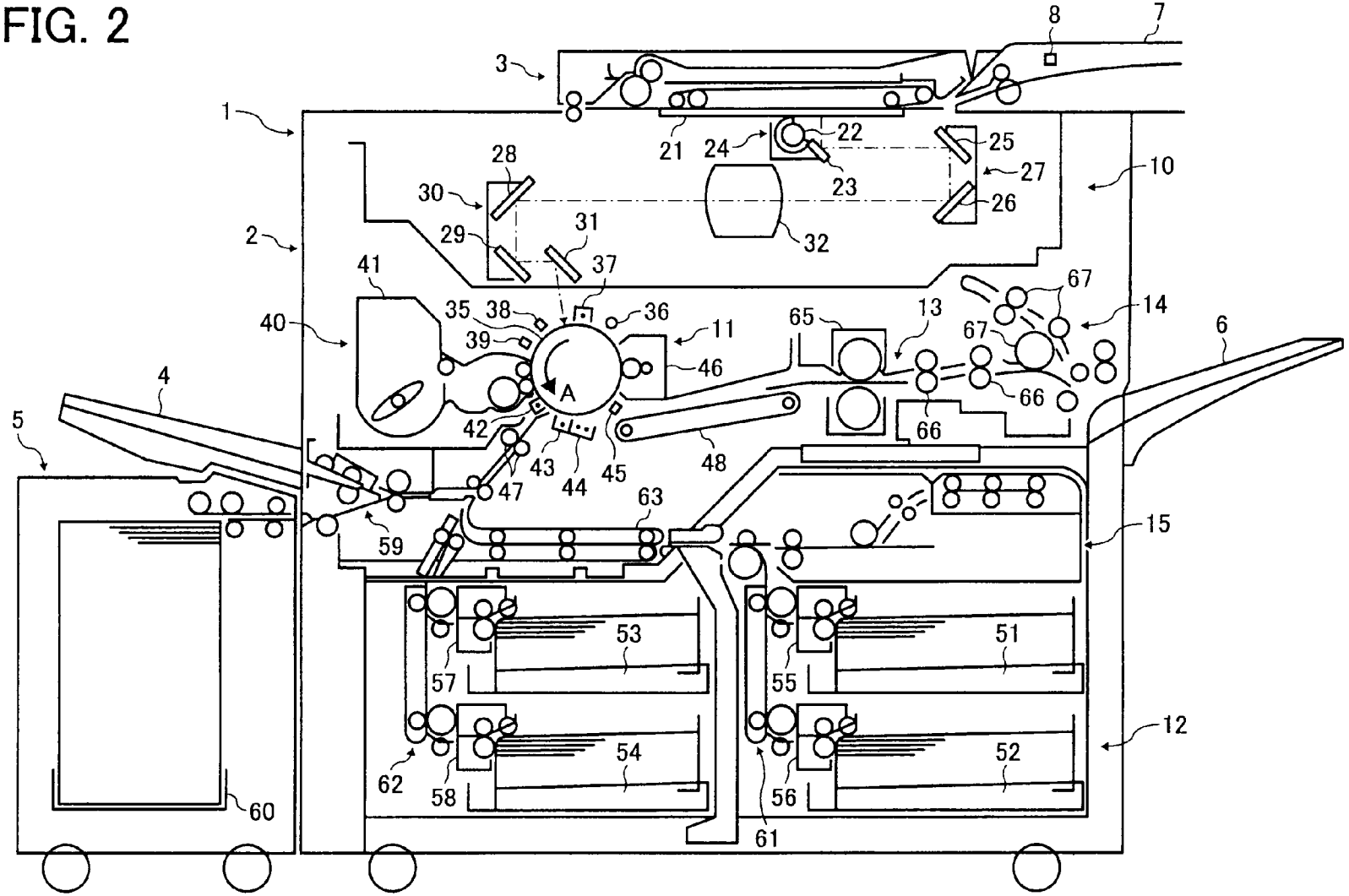
FIG. 2 is a general schematic drawing of an image forming apparatus relating to the present embodiment.

FIG. 2 is a general schematic drawing of an image forming apparatus relating to the present embodiment. The present embodiment may be applied to a composite machine, a copying machine, a printer apparatus (monochrome printer apparatus, digital color printer apparatus), or a facsimile apparatus (G3 fax, Internet fax) which is installed with functions for forming images by visualizing input image data, but the present embodiment is described with reference to the example of a composite machine.

This image forming apparatus 1 is a electrophotographic type of normal-paper composite machine (MFP), in which an automatic original document feeding apparatus (hereinafter, abbreviated to "ADF") 3 is installed on the upper part of the image forming apparatus main body 2, a manual paper supply tray 4 and a large-capacity paper supply apparatus 5 are attached to one side face and a paper output tray 6 is attached to the other side face. Numeral 7 denotes an original document tray for the ADF 3, and it comprises a document loading sensor 8. A scanner unit 10, an image forming unit 11, a paper supply unit 12, a fixing and paper output unit 13, a reversing unit 14, a double-side unit 15, and the like, are also provided inside the image forming apparatus main body 2.

The scanner unit 10 comprises a first scanner 24 comprising a contact glass 21, an exposure lamp 22 and a first mirror 23, a second scanner 27 comprising a second mirror 25 and a third mirror 26, a third scanner 30 comprising a fourth mirror 28 and a fifth mirror 29, a sixth mirror 31, and a lens 32.

The image forming unit 11 comprises, provided about a photosensitive drum 35: a quenching lamp 36, a charging charger 37, an eraser 38, a potential sensor 39, a developing unit 40 fitted with a toner cartridge 41, a pre-transfer charger 42, a transfer charger 43, a separation charger 44, a P sensor 45, and a cleaning unit 46.

Furthermore, a pair of resist rollers 47 are provided before the transfer position in the paper conveyance path, and a conveyance belt 48 is provided after the transfer position.

As trays for stacking or loading paper, a first paper supply tray 51, a second paper supply tray 52, a third paper supply tray 53 and a fourth paper supply tray 54 are provided detachably on the paper supply unit 12.

As paper supply units for supplying the paper stacked in lo the paper supply trays, a first paper supply unit 55, a second paper supply unit 56, a third paper supply unit 57, and a fourth paper supply unit 58 are provided, and furthermore, a manual/large-capacity paper supply unit 59 for supplying paper from the manual paper supply tray 4 or the large-capacity power supply tray (LCT) 60 in the large-capacity paper supply apparatus 5 is also provided.

Moreover, the first paper supply tray 51 to the fourth paper supply tray 54 are each provided with a sensor which determines their respective attachment status, and a sensor which determines whether or not paper is present in the paper supply tray. The first paper supply tray 51 to the fourth paper supply tray 54 and the large-capacity paper supply tray 60 respectively have functions for determining the paper size and the paper orientation, and the manual paper supply tray 4 can also be used by specifying the paper size and the paper orientation used, by means of the operating unit 70 shown in FIG. 4 (described hereinafter) or the terminal apparatus 200. These items of detection information are supplied to a CPU (described hereinafter) which selects and controls the paper supply position, via a sensor sensitivity control unit (described hereinafter).

Moreover, in order to convey the paper supplied from the first paper supply unit 55 to the fourth paper supply unit 58, and the double-side unit 15, to the resist roller pair 47, a right-side conveyor section 61, a left-side conveyor section 62 and a horizontal conveyor section 63 are provided. Furthermore, a fixing unit 65 and a paper output conveyance roller group 66 are provided in the fixing and paper output unit 13, and a reversing roller group 67 is provided in the reversing unit 14.

Next, a general description of the operation of the image forming apparatus 1 having this composition will be given.

The photosensitive drum 35 is supported rotatably on a drum shaft (not illustrated), and it rotates in the direction of the arrow A, in accordance with a copying command, or the like. An original document supplied to the contact glass 21 by the ADF 3 is scanned and exposed with light by the first scanner 24. The reflected light image from same is then directed via the first mirror 23, the second mirror 25, the third mirror 26, the lens 32, the fourth mirror 28, the fifth mirror 29 and the sixth mirror 31, onto the photosensitive drum 35, where it forms an image.

The surface of the photosensitive drum 35 is charged by the charging charger 37 and when this charged surface is exposed by the reflected light image, then a latent electrostatic image is formed thereon. Subsequently, light is irradiated onto the unwanted portions by the eraser 38, thereby correcting the image to a latent image which is suited to the paper or the projected image. In this, in order to obtain an image of equal size, the photosensitive drum 35 and the first scanner 24 are driven at the same speed. The latent image on the photosensitive drum 35 is converted into a real image in the form of a toner image, by the developing unit 40. In this, it is possible to obtain a darker or lighter image by applying a potential (developing bias voltage) to the developing unit 40.

On the other hand, the paper stacked in any one of the first paper supply tray 51, the second paper supply tray 52, the third paper supply tray 53, the fourth paper supply tray 54, the manual paper supply tray 4, the large-capacity paper supply tray 60, or the double-side unit 15, is selected respectively by one of the paper supply units 55 to 58, and the paper is supplied at a prescribed paper supply timing and conveyed via the right-side conveyor section 61, the left-side conveyor section 62, the horizontal conveyor section 63, and the like, to the resist roller pair 47 which have been halted in advance. The resist roller pair 47 are driven at the timing where the leading edge of the toner image on the photosensitive drum 35 coincides with the leading edge of the paper.

In this way, the toner image on the photosensitive drum 35 is transferred to the paper by the action of the pre-transfer charger 42 and the transfer charger 43. Here, since the surface of the photosensitive drum 35 is extremely smooth and there is a high adhesive force between the surface of the drum and the paper, the electric potential of the paper is lowered by the action of the separation charger 44, thereby lowering the adhesive force.

Thereupon, the paper is separated from the photosensitive drum 35 by means of a separating hook (not illustrated), and the separated paper is conveyed to the fixing unit 65 by the conveyance belt 48. Heat and pressure are applied to the toner on the paper conveyed to the fixing unit 65, thereby fixing the toner image onto the paper, and the paper is then output to the paper output tray 6 outside the machine by the paper output conveyance roller group 66. When performing double-side copying, or the like, the paper is conveyed temporarily into the reversing unit 14, where the conveyance direction is reversed and the paper is then fed into the double-side unit 15, which re-supplies the paper to the image forming unit 11 in order to copy an image of the next face of the original document.

Since toner that has not been transferred completely remains attached to the surface of the photosensitive drum 35 after transfer, the surface is cleaned by the brush and cleaning blade of the cleaning unit 46, whereupon the uneven surface potential is set to a uniform value by the quenching lamp 36.

The respective control times of these operations are chiefly regulated by a control circuit (not illustrated) on the basis of a pulse generated in synchronism with the rotation of the photosensitive drum 35, or a reference pulse for driving the photosensitive drum 35.

Figure 3:
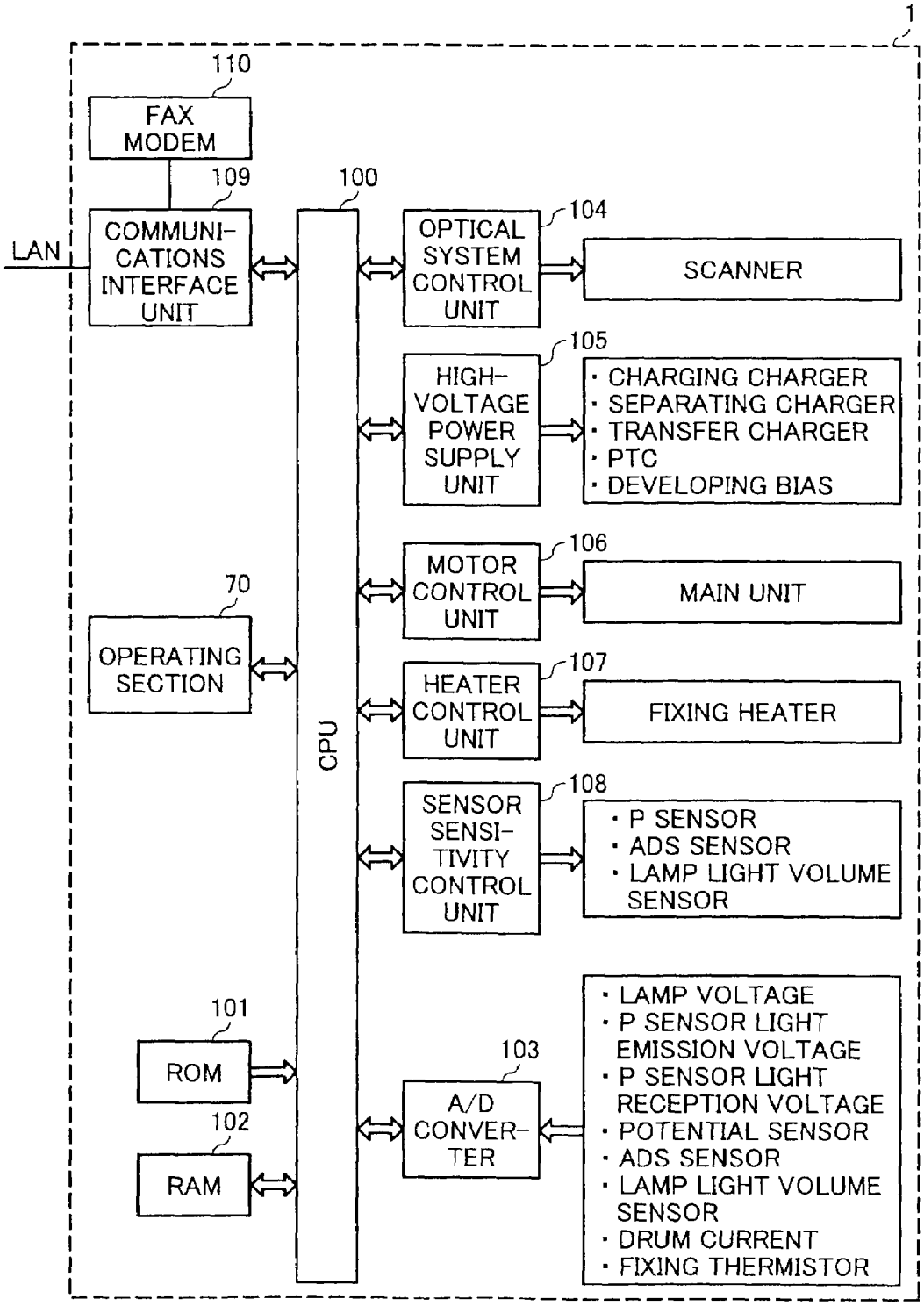
FIG. 3 is a block diagram showing the composition of a control system for the image forming apparatus.

FIG. 3 is a block diagram showing the composition of a control system of the image forming apparatus 1 shown in FIG. 2. In FIG. 3, the operation of the image forming apparatus main body 2 is controlled by the CPU 100 on the basis of a control program and data stored in the ROM 101. Furthermore, a RAM 102 is used in order to store intermediate processing results, various setting values, the status of the apparatus, and the like.

An A/D converter 103 is used to input the supply voltage to the exposure lamp 22, the light emission voltage and light reception voltage of the P sensor 45, the output of the potential sensor 39, the output of the ADS sensor, the output of a lamp light volume sensor which determines the light volume emitted by the exposure lamp 22, the output of a drum current sensor which determines the current flowing through the photosensitive drum 35, the thermistor voltage inside the fixing unit 65, and the like.

An optical system control unit 104 controls the scanner unit 10 shown in FIG. 2. A high-voltage power supply unit 105 supplies a high-voltage which is applied respectively to the charging charger 37, the separation charger 44, the transfer charger 43, and the pre-transfer charger (PTC) 42, and it also supplies a developing bias voltage which is applied to the developing roller in the developing unit 40.

A motor control unit 106 controls a main motor which drives the photosensitive drum 35, the respective paper supply units, and the rollers of the conveyance sections, and the like. The motor control unit 107 controls the passage of current to the fixing heater which heats the fixing rollers in the fixing unit 65, thereby keeping the surface temperature of the fixing rollers to within a prescribed range. A sensor sensitivity control unit 108 is used to alter the light reception gain of the lamp light volume sensor, the light reception gain of the ADS sensor, the light reception gain of the P sensor 45, and the LED light emission voltage of the P sensor 45, and the like.

A communications interface unit 109 implements communications-related control processing, such as connecting the image forming apparatus 1 to a PSTN (Public Subscriber Telephone Network) according to a G3 fax communications control procedure, by connecting to a fax modem 110, or connecting to a local area network 300 via a NIC (Network Interface Card). A NIC (Network Interface Card) connects the image forming apparatus 1 to an Ethernet (registered trademark) cable of a local area network, and ensures functions for transmission control procedures, such as TCP/IP.

Figure 4:
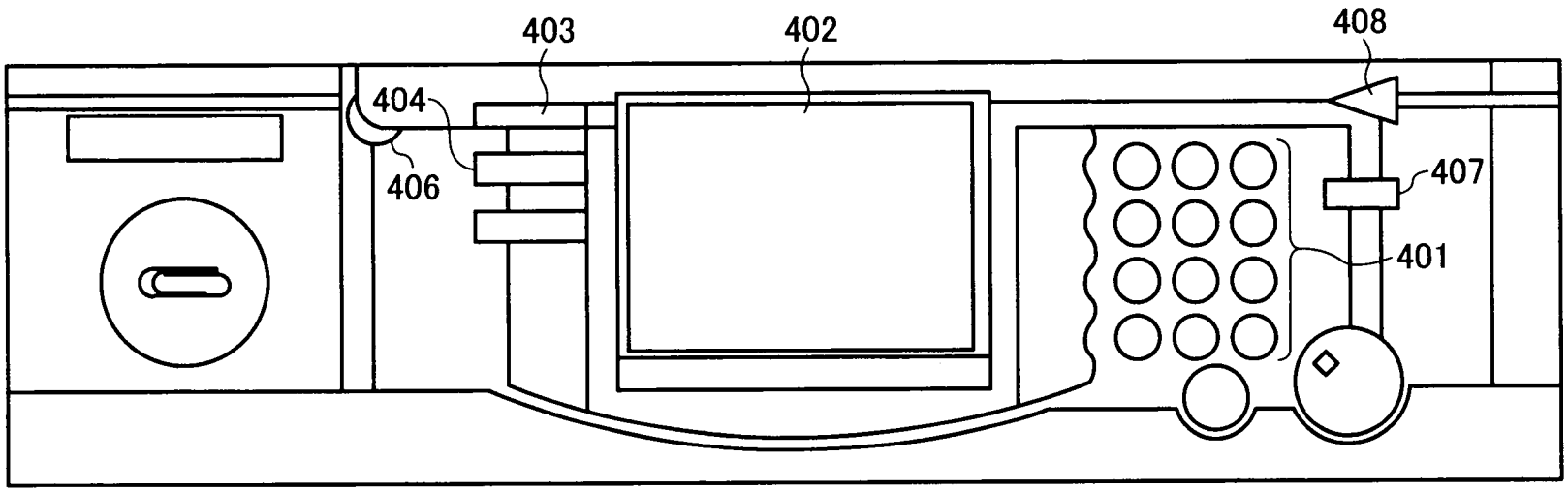
FIG. 4 is a diagram showing one compositional example of an operating section of the image forming apparatus.

FIG. 4 shows one example of an operating section 70 of an image forming apparatus 1. This operating section 70 comprises hard keys, such as a calculator pad, a liquid crystal display, and touch panel keys located on the liquid crystal display. The calculator pad keys 401 are used to set the number of copies, and the like. The liquid crystal display screen 402 shows a settings screen indicating the paper supply information and mode, and messages, or the like, and it also displays a touch panel in a superimposed fashion. A guidance key 403 is used to switch to a mode which displays a description of the functions or the operating procedure.

A program key 404 is used to register or call up settings which are used regularly. A brightness adjustment knob 406 is used to adjust the brightness of the liquid crystal display screen 402. A mode clear/preheat/timer key 407 is used to cancel the current settings, and if pressed down continuously for a prescribed time or more, it sets the apparatus to a preheating state. An interrupt key 408 is used to interrupt the current copying operation, and to copy another document.

Figure 5:
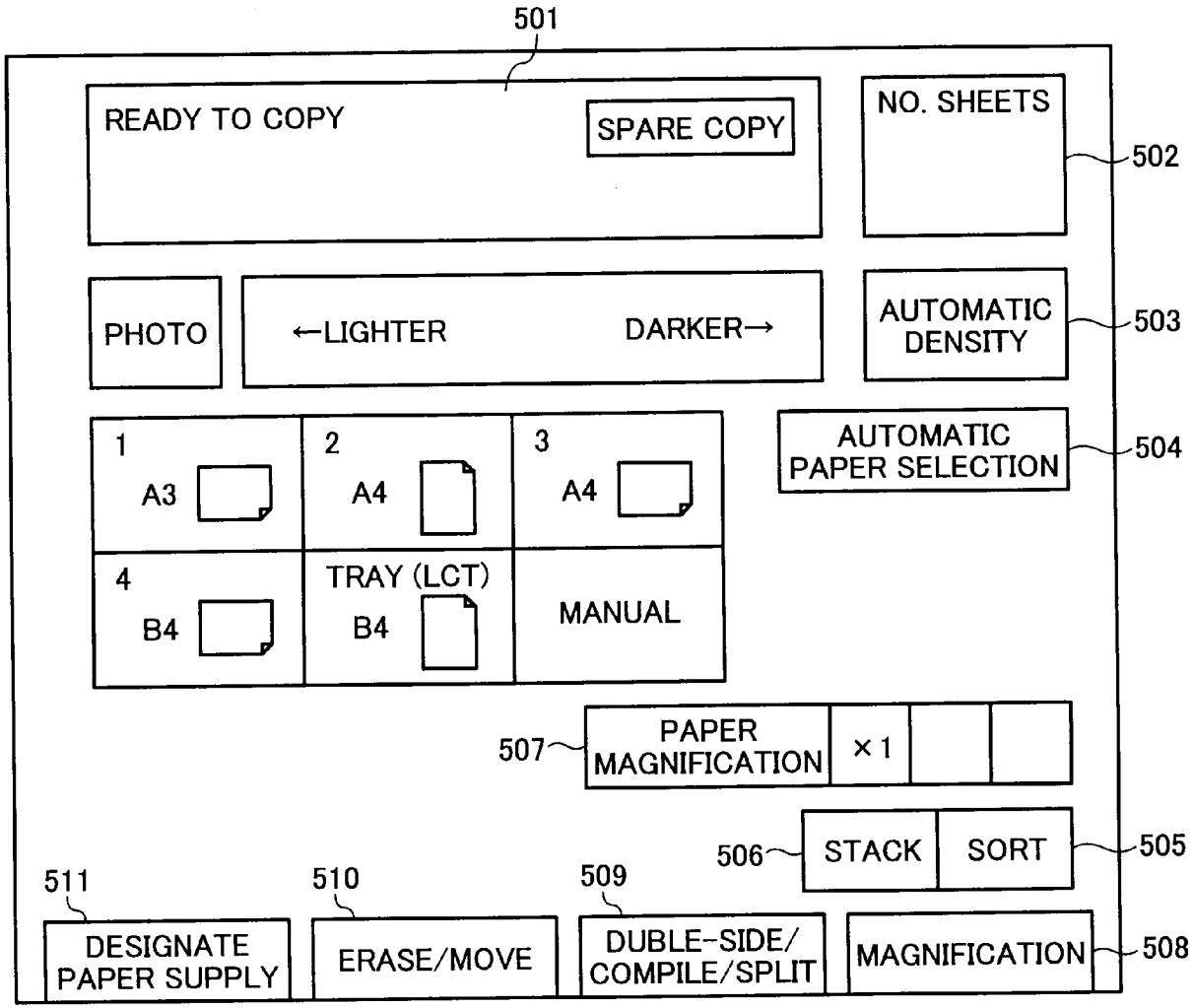
FIG. 5 is a diagram showing one example of a liquid crystal display screen of the operating section.

FIG. 5 shows one example of the liquid crystal display screen 402 of the operating section 70. A touch panel is superimposed on the screen, and keys are arranged in accordance with icons displayed on the liquid crystal display. In FIG. 5, a message display area 501 stating "Ready to Copy" or "Please Wait", a sheet number display section 502, a density selector key 503, a paper supply tray selector key 504, a note key 505, a stack key 506, a paper magnification key 507, a magnification mode key 508, a double-side/compile/split mode key 509, an erase/move mode key 510, and a paper supply designation key 511 are displayed.

The settings of the various conditions according to the present embodiment are described in detail below.

Figure 6:
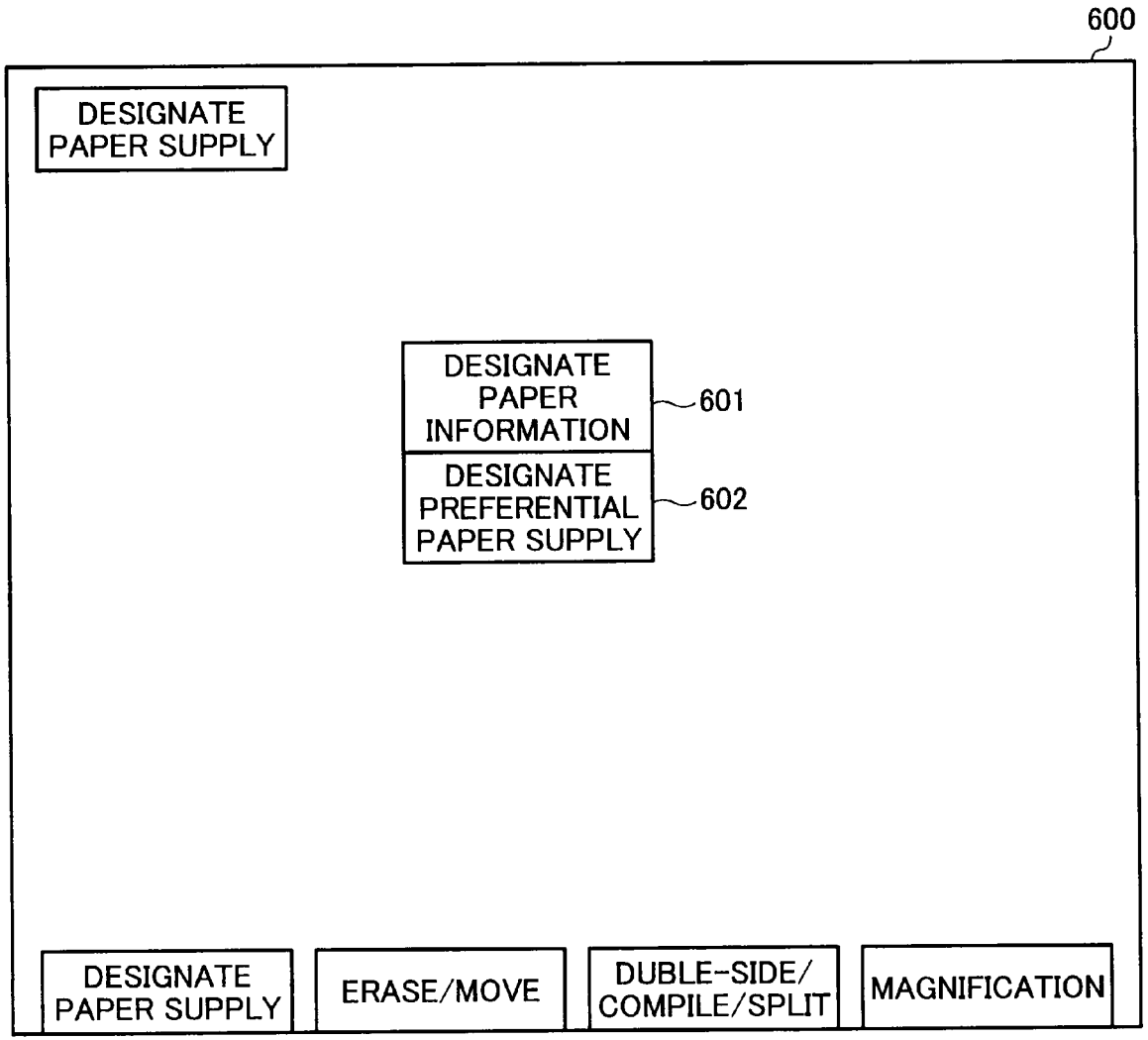
FIG. 6 is a diagram showing one example of a screen for designating paper supply.

FIG. 6 shows one example of a paper supply designation mode displayed on the liquid crystal display screen, and it shows a paper supply designation screen 600 which is displayed on the liquid crystal display screen 402 of the operating section 70 when the paper supply designation key icon 511 is touched on the menu screen shown in FIG. 5.

The paper supply designation key icon 511 is used to designate various conditions relating to the present embodiment, in accordance with the use required by the user, and the paper supply designation screen 600 comprises a paper information designation icon 601 which designates the set paper information, and a preferential paper supply designation icon 602 which designates the paper supply unit to be selected preferentially, when paper has been set in the paper supply trays 51 to 54 attached to the paper supply units 55 to 58, the manual paper supply tray 4 (only when selectable) and the large-capacity tray (LCT) 60 in the large-capacity paper supply apparatus 5. One of these paper sources is designated by operating the icons on the message displayed on the liquid crystal display screen 402.

Figure 7:
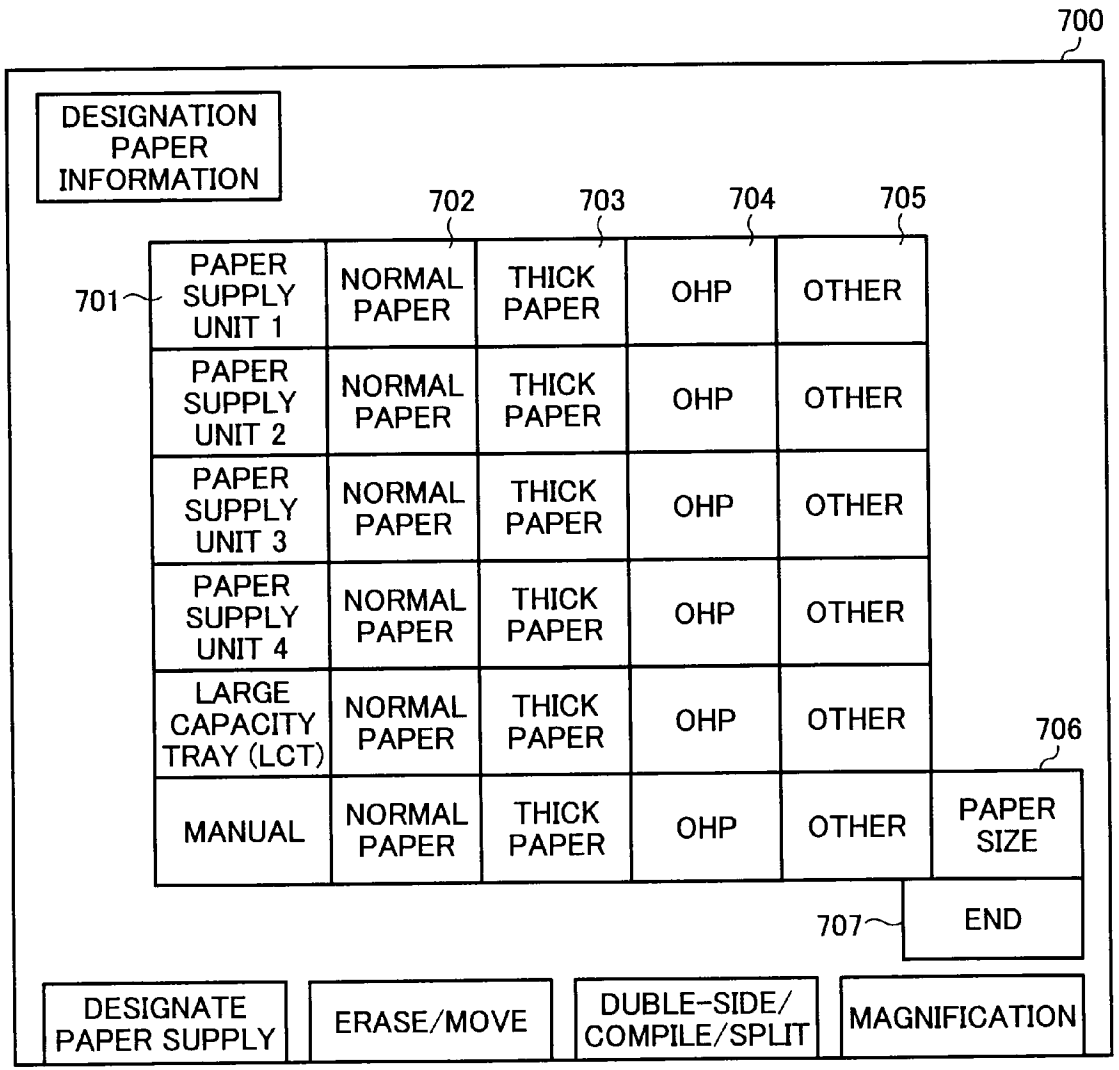
FIG. 7 is a diagram showing one example of a paper information designation screen.

FIG. 7 is a diagram showing a menu screen 700 for designating the information on the paper set in the paper supply units 55 to 58, the manual paper supply tray 4, and the large-capacity paper supply tray (LCT) 60. In FIG. 7, by touching the paper information designation icon 601 on the paper supply designation menu screen 600 shown in FIG. 6, the screen shown in FIG. 7 is displayed on the liquid crystal display screen 402 and a designation operation can be started.

For example, if normal paper has been loaded into the first paper supply unit, then this is selected by touching the normal paper icon 702. A similar selection is made for the other paper supply units, and when designation has been completed for all of the paper supply units, then the designation operation is ended by touching the end icon 707. By means of this designation operation, the image forming apparatus can judge the paper information for the paper loaded in the paper supply trays which are attached each of the paper supply units, and it can control operation in such a manner that paper is supplied from a paper supply tray loaded with the desired paper.

Figure 8:
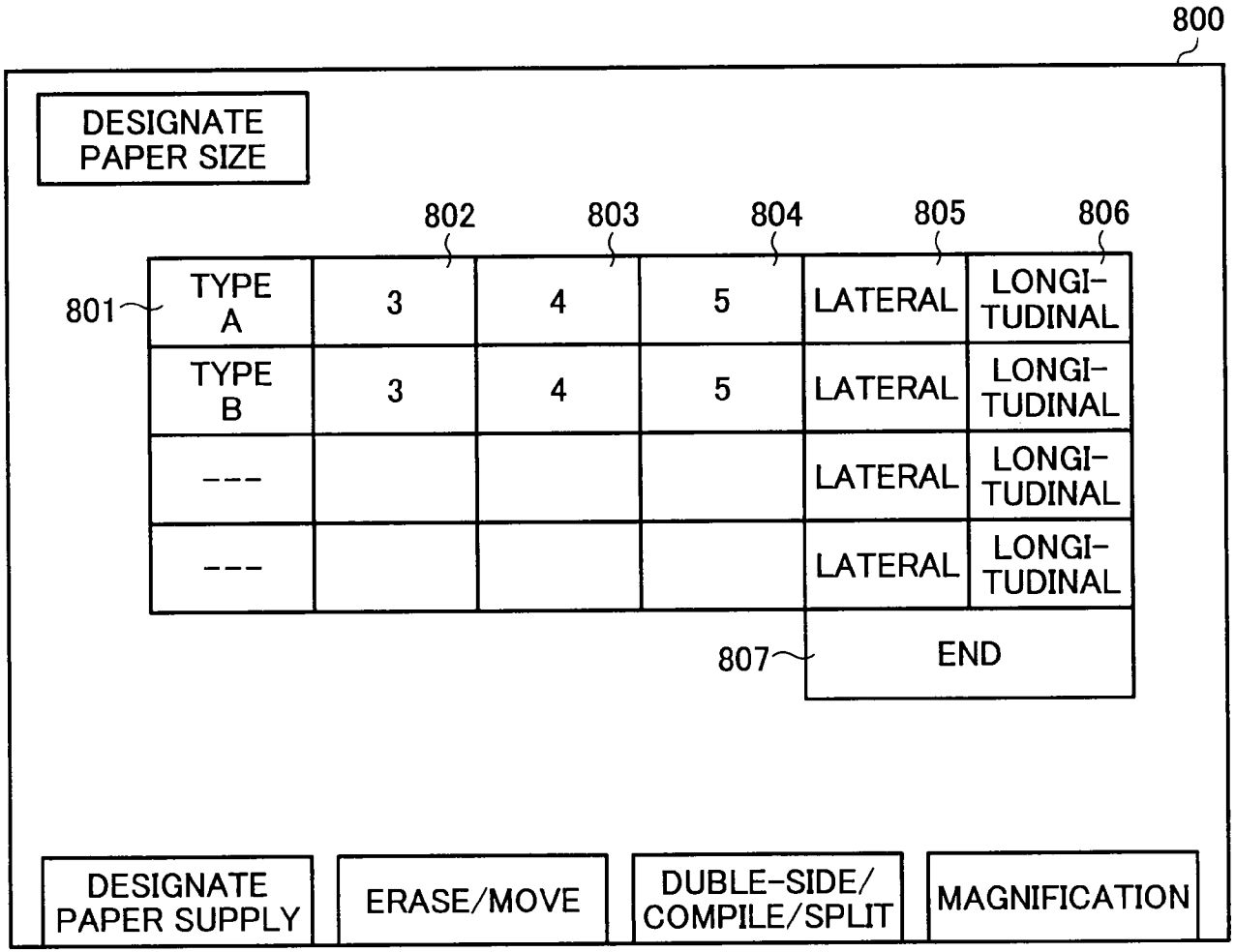
FIG. 8 is a diagram showing one example of a paper size designation screen.

FIG. 8 is a diagram showing a menu screen 800 for designating the size of paper loaded in the manual paper supply tray 4. In FIG. 8, by touching the paper size designation icon 706 on the paper information designation menu screen 700 shown in FIG. 7, the screen shown in FIG. 8 is displayed on the liquid crystal display screen 402 and the designation operation can then be started.

For example, if A4 paper has been loaded in portrait orientation in the manual paper supply tray 4, then the A4 size icon 803 is touched and selected, the portrait icon 806 is touched and selected, and finally, the end icon 807 is touched, thereby ending the designation process. As a result of this designation operation, the image forming apparatus judges the paper information for the paper that has been loaded in the manual paper supply tray 4, and it controls operation in such a manner that this paper is supplied.

In the present embodiment, a function for determining paper information (paper size, paper orientation, etc.) is provided respectively in the paper supply trays 51 to 54 and the large-capacity tray 60, and therefore they do not require an operation for designating paper information. However, if this function is not provided, then it is of course also possible to designate the paper information by means of this operation.

Figure 9:
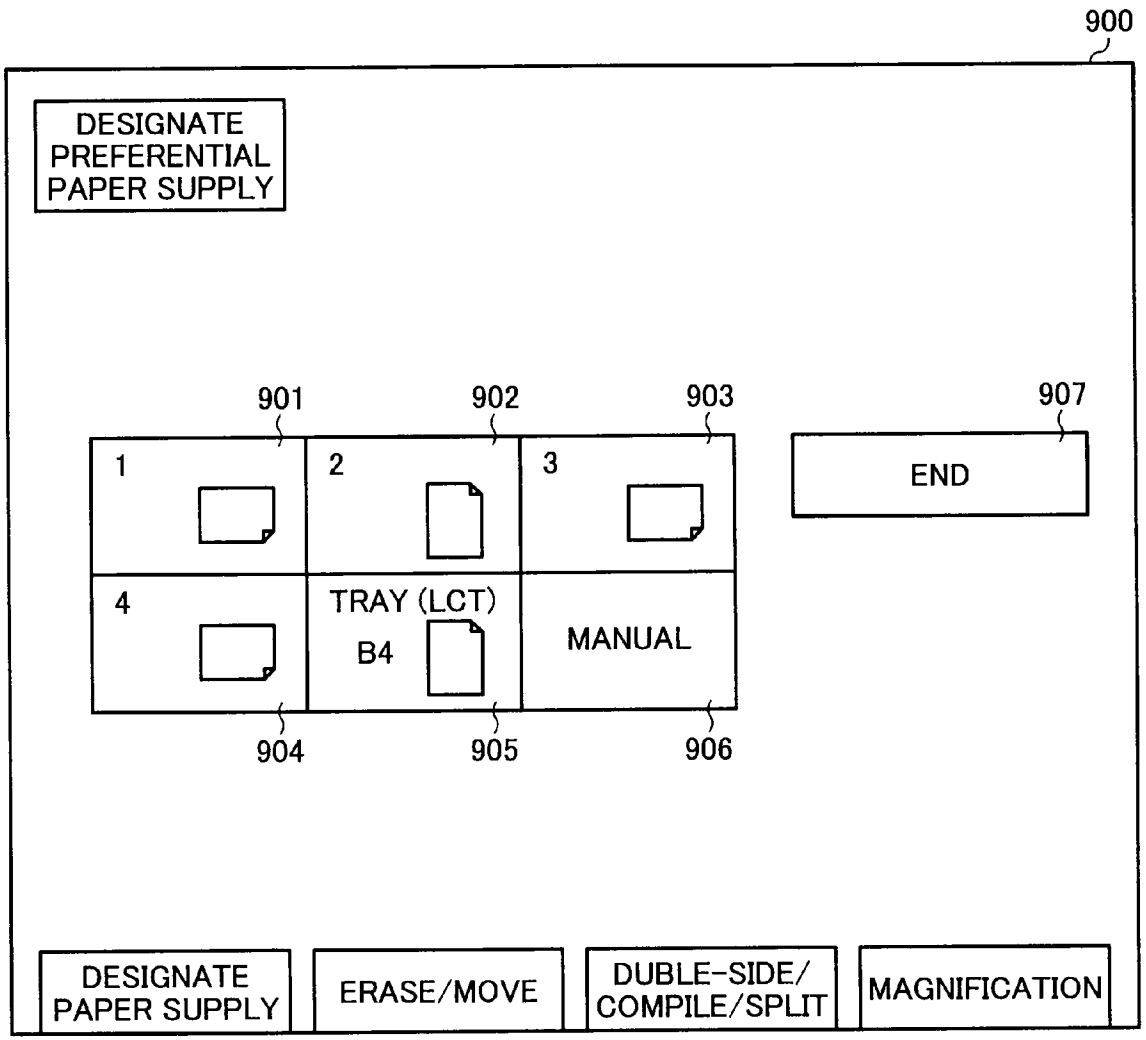
FIG. 9 is a diagram showing one example of a preferential paper supply designation screen.

FIG. 9 shows a menu screen 900 for designating a preferential paper supply unit. In FIG. 9, when the preferential paper supply designation icon 602 on the paper supply designation menu screen 600 shown in FIG. 6 is touched, the screen shown in FIG. 9 is displayed on the liquid crystal display screen 402 of the operating section 70, and a designation operation can be started.

For example, if the 2 icon 902 for the second paper supply unit 56 is touched and selected, and the end icon 907 is then touched, then the second paper supply unit 56 is designated as the preferential paper supply unit. If the manual paper supply tray 4 is not attached, then a search order table is created, taking the second paper supply unit 56 to be the first search position, followed by the third paper supply unit 57, the fourth paper supply unit 58, the large-capacity paper supply tray (LCT) 60 in the large-capacity paper supply apparatus 5, and the first paper supply tray 55, in that order.

Furthermore, if the manual paper supply tray 4 is attached, then a search order table is created by setting the manual paper supply tray as the first search position, followed by the first paper supply unit 55, the second paper supply unit 56, the third paper supply unit 57, the fourth paper supply unit 58 and the large-capacity tray (LCT) 60 in the large-capacity paper supply apparatus 5. By referring to the search order table thus created, the apparatus searches for and identifies a paper supply unit fitted with a paper supply tray loaded with paper having paper information that matches the paper on which the input image is to be formed, and it implements control in such a manner that the matching paper supply unit is selected.

As described above, it is possible to set the paper information to a manual paper supply tray for supplying paper manually, or to a paper supply tray attached to one of a plurality of paper supply units, and furthermore, a preferential paper supply unit can be designated. Consequently, the operability of the apparatus is improved and the usability for the user can also be enhanced.

The image forming apparatus 1 according to the present embodiment has a paper supply composition comprising four paper supply units 55 to 58, one manual paper supply tray 4 and a large-capacity paper supply unit 60, and when selecting a paper supply tray from amongst these paper supply units, one of two selection methods is used: a method where selection is made by operating the operating section 70 in FIG. 4, or a method where selection is made on the basis of a paper supply unit selection command attached to the image data input from the terminal apparatus 200.

Figure 10A:
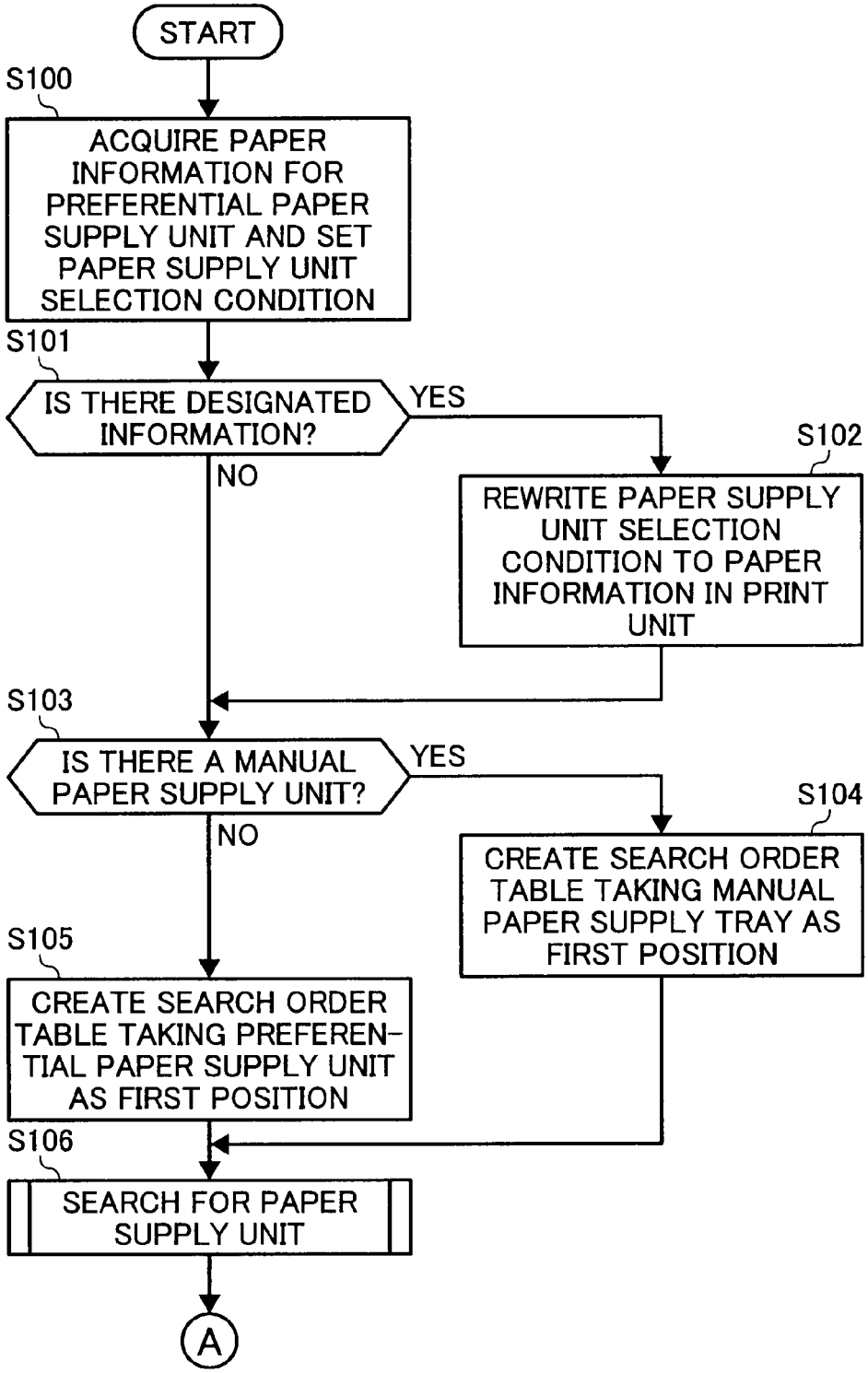
FIGS. 10A and 10B are flowcharts for describing the details of processing for forming an input image on paper supply from a paper supply tray attached to a selected paper supply unit.
Figure 10B:
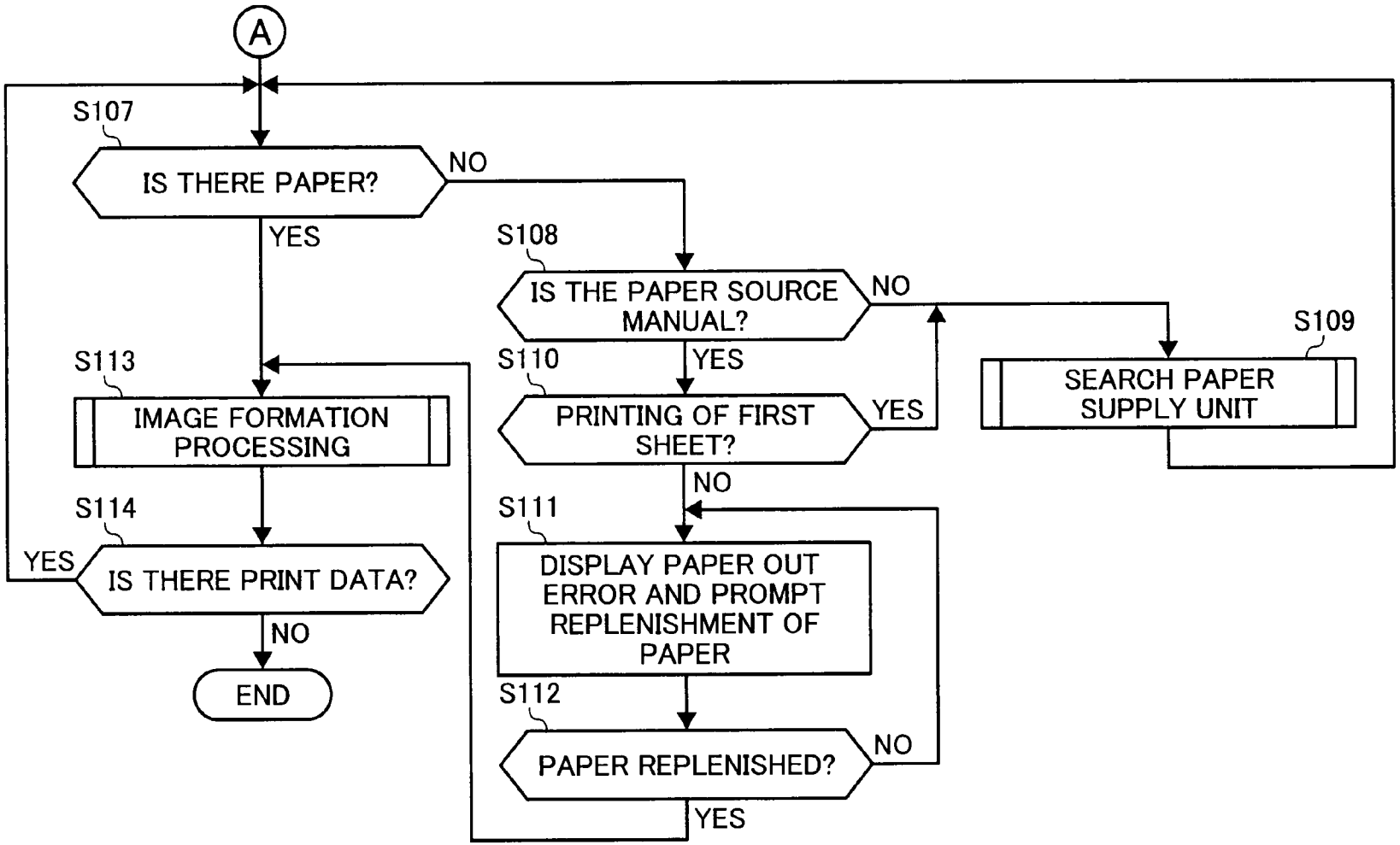

Next, the processing for forming an input image on paper supplied from a paper supply tray attached to a selected paper supply unit will be described in detail with reference to the flowcharts in FIGS. 10A and 10B.

Firstly, when image data is input to the image forming apparatus main body 2, from a scanner unit 10 or terminal apparatus 200, the paper information (paper size and paper orientation, etc.) of the paper loaded in the paper supply tray attached to the paper supply unit designated as the preferential paper supply unit is acquired, and a condition for selecting the paper supply unit (hereinafter, paper supply unit selection condition) is set (step S100).

Thereupon, it is investigated whether or not paper information is attached to the input image data, and if such information has been designated (YES at step S101), then the paper supply unit selection condition is changed to the paper information attached to the input image data (step S102).

Thereupon, it is investigated whether or not a manual paper supply tray 4 is attached, and if it is attached (YES at step S103), then a search order table is created, taking the manual paper supply tray 4 as the first search position (step S104). Here, if paper information has been input previously for the manual paper supply tray, then this paper information is set as the paper supply unit selection condition. If, on the other hand, the manual paper supply tray 4 is not attached (NO at step S103), then a search order table is created by taking the preferential paper supply unit as the first search position (step S105).

When a search order table has been created, the control procedure shifts to a paper supply unit search task (see FIG. 11), and it searches for a paper supply unit by referring to the search order table (step S106). When the control procedure returns from the paper supply unit search task, it is investigated whether or not paper is loaded in the paper supply tray attached to the selected paper supply unit, and if paper is loaded in this tray (YES at step S107), then the control procedure returns to step S113 for image formation.

On the other hand, if a paper out (no remaining paper) situation is detected (NO at step S107), then it is investigated whether or not the paper source is the manual paper supply tray, and if the paper source is not the manual paper supply tray (NO at step S108), then the control procedure transfers to step S109 in order to switch the paper supply unit. Furthermore, if the paper source is the manual paper supply tray, which is empty (YES at step S108), and if this is the first print sheet (YES at step S110), then the control procedure shifts to step S109 in order to switch the paper supply unit of the paper source. In the paper supply tray search task at step S109, a search operation is carried out while excluding the paper supply unit that is currently selected. When the control procedure returns from the paper supply tray search task, the control procedure then transfers to step S107.

On the other hand, if the paper source is an empty manual tray and if this is the second or subsequent print sheet (NO at step S110), then a message prompting replenishment of paper to the manual tray is displayed on the liquid crystal display screen 402 of the operating section 70 (step S111), and the apparatus then waits until the paper is replenished (NO at step S112). When paper has been replenished in the manual tray (YES at step S112), then print processing is carried out by subjecting the input image data to image processing, writing the processed image as a latent image onto the photosensitive drum 35 by laser light, converting same into a real image by depositing toner thereon, transferring the toner image in one action onto paper supplied from the selected paper supply tray, fixing the toner image onto the paper by means of a fixing unit, and then outputting the paper to the paper output tray 6 (step S113).

When the printing of one sheet has completed, it is investigated whether or not there exists image data to be printed subsequently, and if such image data exists (YES at step S114), then processing is continued by returning to step S107 in order to process the next image data. If, on the other hand, no such image data exists (NO at step S114), then the processing terminates.

By means of the composition described above, it is possible to supply the paper intended by the user, at all times, by means of one operation, without requiring a plurality of operations to be performed each time an input image is to be formed, as in the prior art. Therefore, the time required for operation, and the like, is reduced, the load on the image formation system is reduced, system performance is stabilized and system throughput is greatly improved.

Furthermore, it is possible to print image data transferred from a terminal apparatus or image data input from a scanner unit, onto paper desired by the user, and if a paper out (no remaining paper) situation occurs, then it is still possible to print onto the paper intended by the user, by interrupting the processing until paper is loaded, without requiring wasteful operations, such as changing the paper supply tray and resetting the paper information.

Next, the processing of the paper supply unit search task will be described.

Figure 11:
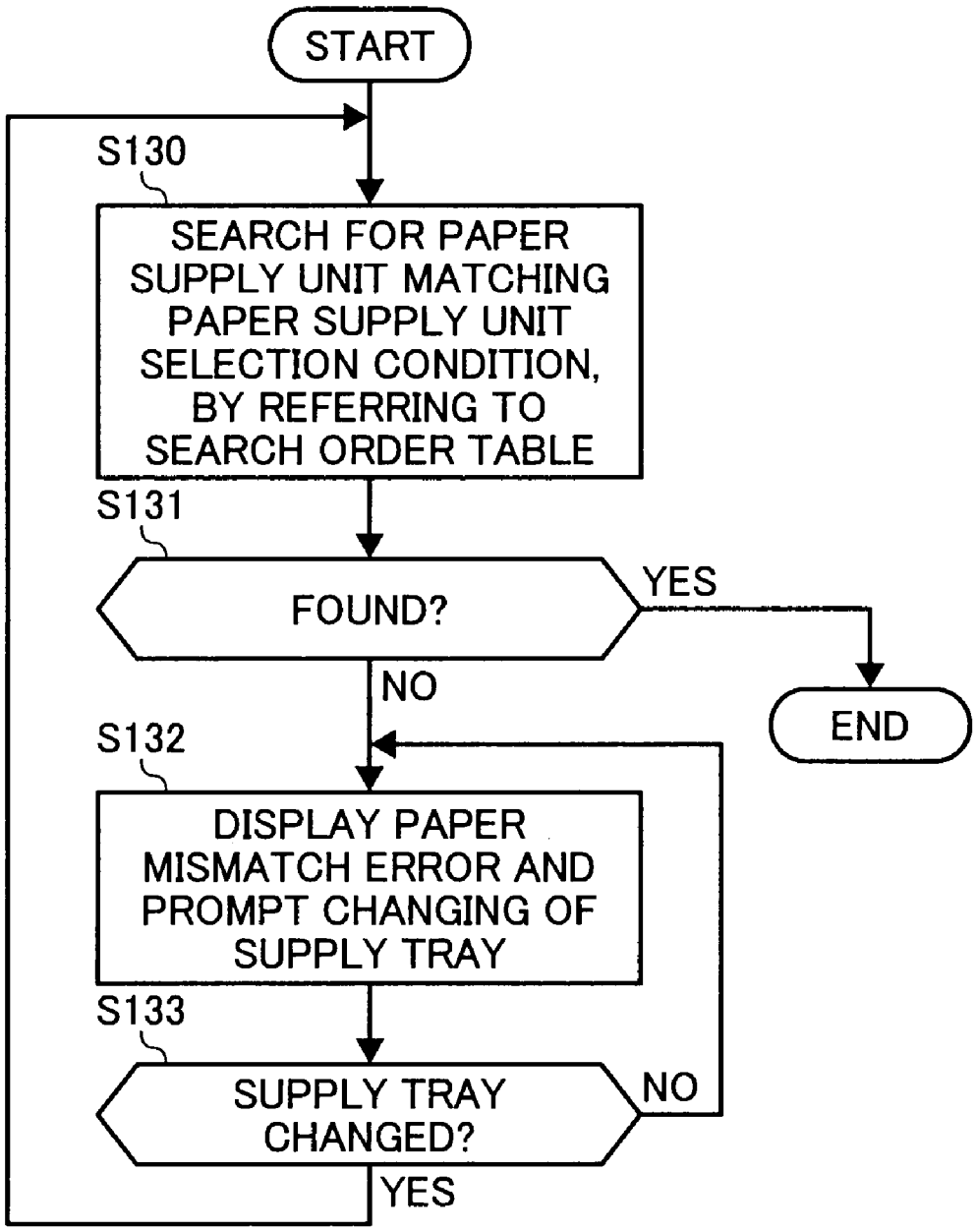
FIG. 11 is a flowchart for describing a processing sequence for searching for a paper supply unit matching selection conditions, by referring to a search order table.

FIG. 11 is a flowchart for describing the processing sequence of searching for a paper supply unit fitted with a paper supply tray which matches the paper supply unit selection conditions, by referring to the search order table.

When the control procedure transfers to a paper supply unit search task, then the apparatus searches for a paper supply unit fitted with a paper supply tray which matches the paper supply unit selection conditions (paper size, paper orientation, etc.), by referring to the search order table (step S130). In this case, the paper information (paper size, paper orientation, etc.) of the paper loaded in the paper supply tray fitted to the paper supply unit set in the search order table is determined and then compared with the paper supply unit selection conditions. The paper information of the paper supply trays fitted to the paper supply units is determined each time in this way, in order to avoid the need to create a new search order table when one of the paper supply trays is changed.

Furthermore, at the second or subsequent search requests, the currently selected paper supply unit is excluded from the comparison process. If there is a paper supply unit fitted with a paper supply tray loaded with paper that matches the paper supply unit selection conditions in the aforementioned comparison (YES at step S131), then that paper supply unit is selected and control is then returned to the source of the request.

On the other hand, in the aforementioned comparison operation, if there is no paper supply unit fitted with a paper supply tray loaded with paper matching the paper supply unit selection conditions (NO at step S131), then a message prompting the attachment of a paper supply tray loaded with paper matching the paper supply unit selection conditions is displayed on the liquid crystal display screen 402 of the operating section 70 (step S132), the apparatus waits until a paper supply tray is attached (NO at step S133), and when a paper supply tray is attached (YES at step S133), then the control procedure returns again to step S130 in order to perform a search.

Finally, a process for selecting the manual paper supply tray in a case where there is no function for determining the paper information (paper size, paper orientation, etc.) of the manual paper supply tray will be described.

If the information on the paper loaded in the manual paper supply tray cannot be determined, then it is not possible to set supply unit selection conditions. There are the following two ways of avoiding this situation.

(1) The user sets the paper information for the manual paper supply tray in advance from the operating section 70 of the image forming apparatus.

(2) The paper information for the paper supply tray attached to the preferential paper supply unit is rewritten as the paper information of the manual paper supply tray. In this way, the operation for setting paper information as described in (1) can be omitted.

In cases such as these, if the manual paper supply tray has been registered in the search order table for the search in step S130, during the processing of the paper supply unit search task shown in FIG. 11, then it is searched using the paper information for the manual paper supply tray obtained by either one of methods (1) or (2) described above.

Needless to say, the object of the present invention can also be achieved by converting the respective functions which constitute the image forming apparatus, the image forming system, and the terminal apparatus relating to the first embodiment described above, into programs, writing same previously onto a storage medium, such as a CD-ROM, inserting the CD-ROM in a recording medium reading apparatus provided in the image forming apparatus or terminal apparatus and installing the respectively corresponding programs, and then executing the programs by means of the CPUs provided in the apparatuses.

In this case, the functions relating to the embodiment described above are achieved by the programs when they are read out from the recording medium and executed, and hence the programs and the recording medium on which the programs are recorded constitute the present invention.

The programs which realize these functions may be presented as a recording medium of any format from among a semiconductor medium (for example, a ROM, non-volatile memory, or the like), an optical medium (for example, a DVD, MO, MD, CD, or the like), or a magnetic medium (for example, magnetic tape, flexible disk, or the like).

Alternatively, a program stored in a storage apparatus may be supplied directly from a server computer, by means of a communications network. In this case, the storage apparatus of the server computer is also included in the storage media of the present invention.

Moreover, in addition to cases where the functions relating to the first embodiment described above are achieved by executing a program, it also includes cases where the functions relating to the first embodiment described above are achieved by conjoint processing with an operating system or another application program, on the basis of the instruction of the program.

As described above, according to the first embodiment, it is possible to prevent situations where the user forgets to set the paper information (paper size, paper orientation, etc.) for image forming, to prevent the supply of paper that is not intended by the user, and hence to obtain the print results desired by the user at all times.

Furthermore, rather than performing a plurality of operations, each time an input image is formed on the paper, as in the prior art, it is possible reliably to receive a supply of paper corresponding to the paper information intended by the user, by means of one operation. Therefore, the time required for operation is reduced, as well as reducing the burden on the image forming system, and stabilizing system performance and increasing throughput, which contributes greatly to improving customer satisfaction.

Second Embodiment

Below, a second embodiment will be described in detail with reference to the drawings.

Figure 12:
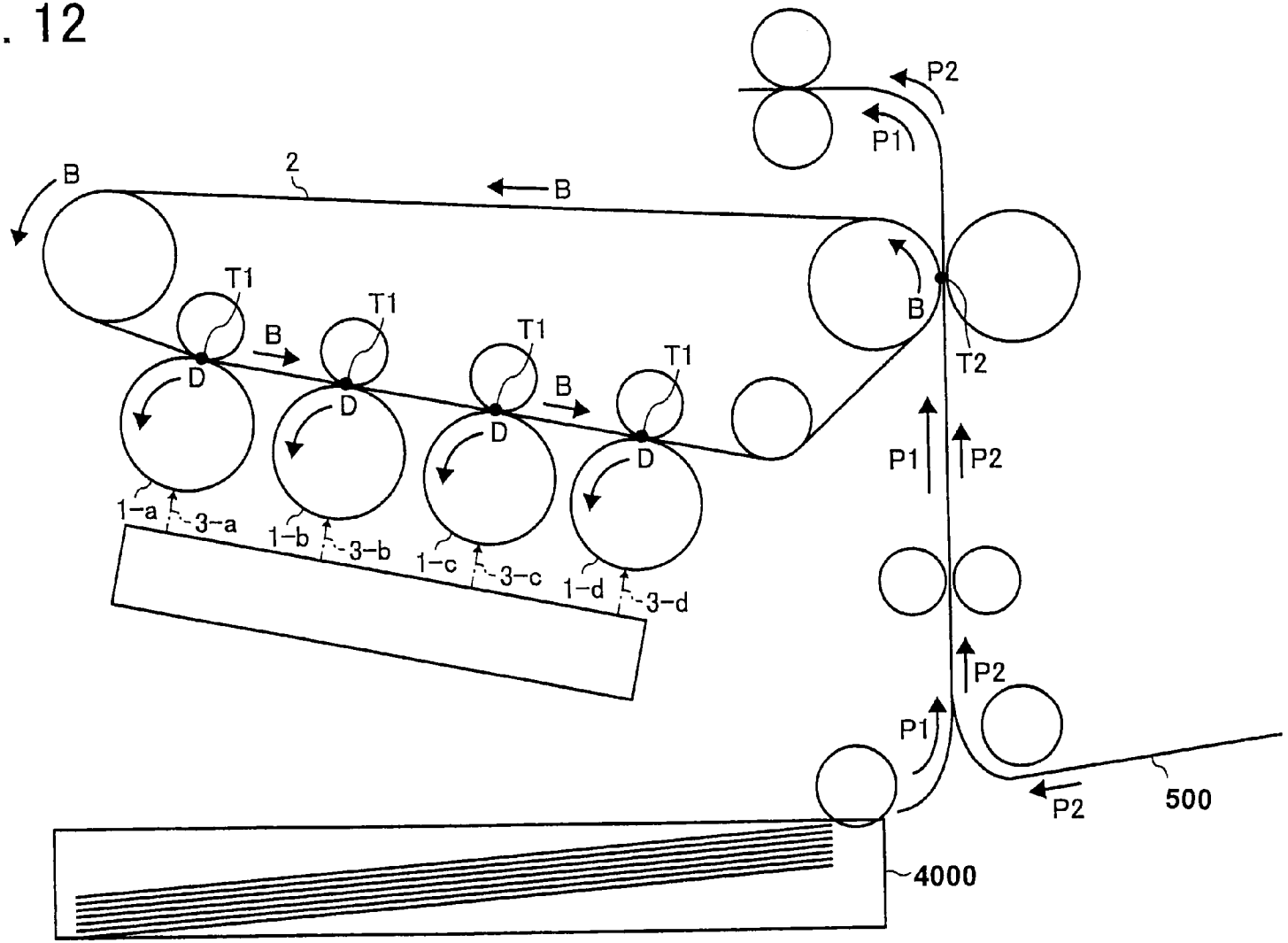
FIG. 12 is a side view showing the principal composition of a plotter unit in an image forming apparatus according to a second embodiment of the present invention.

FIG. 12 shows a principal composition of an image forming apparatus relating to this second embodiment.

This image forming apparatus is based on an electrophotographic system, and as shown in FIG. 12, it comprises: drum-shaped photosensitive bodies 1-*a*, 1-*b*, 1-*c*, 1-*d* which correspond respectively to the four color elements Y, M, C, K (Yellow, Magenta, Cyan, Black); an endless intermediate transfer belt 2 which makes contact with the photosensitive bodies and onto which toner images from the photosensitive bodies are transferred; LD apparatuses 3-*a*, 3-*b*, 3-*c*, 3-*d* for irradiating laser light onto the photosensitive bodies of the respective colors; a main body paper supply unit 4000 which supplies paper for printing from a tray situated inside the image forming apparatus; and a manual paper supply unit 500 which supplies paper relating to manual printing.

A sensor for determining the presence or absence of paper is provided respectively in the main body paper supply unit 4000 and the manual paper supply unit 500.

Below, an image forming operation in the image forming apparatus having the composition described above will be described.

By means of the LD apparatuses 3-*a*, 3-*b*, 3-*c*, 3-*d*, laser lights for the respective colors modulated by the prescribed image data are irradiated onto the respective photosensitive bodies 1-*a*, 1-*b*, 1-*c*, 1-*d* which rotate in the direction D in FIG. 12. Consequently, electrostatic latent images of the corresponding color elements are formed on the photosensitive bodies 1-*a*, 1-*b*, 1-*c*, 1-*d*.

The electrostatic latent images on the respective photosensitive bodies are developed respectively using toners of the corresponding colors by means of a developing apparatus, which is not illustrated.

In this way, the toner images of respective colors formed on the respective photosensitive bodies 1-*a*, 1-*b*, 1-*c*, 1-*d* are transferred successively at the point T1 in the diagram, onto the intermediate transfer belt 2, which is driven to rotate in the direction B in the diagram, by means of drive rollers. In this, the transfer timing is controlled in such a manner that the toner images of the respective colors are mutually superimposed in an accurate fashion on the intermediate transfer belt 2. Consequently, the toner images of the respective colors are superimposed on the intermediate transfer belt 2, and hence a prescribed full color toner image is formed.

The full color toner image formed on the intermediate transfer belt 2 in this way is conveyed by the belt 2, as the belt 2 is driven in rotation in direction B. The full color toner image on the intermediate transfer belt 2 makes contact at point T2 with the paper supplied from the main body paper supply unit 4000 or the manual paper supply unit 500, respectively via P1 or P2, and it is transferred onto the paper. Consequently, a full color toner image is formed on the paper and a desired printing result is obtained.

The image forming process based on an electrophotographic method of this kind in the present image forming apparatus is commonly known, and detailed description thereof is omitted here.

Figure 13:
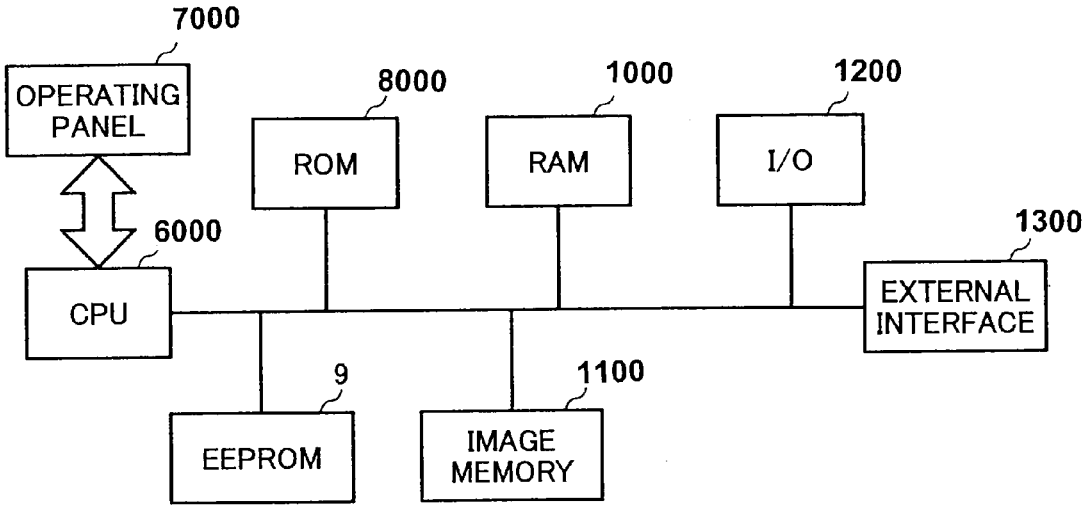
FIG. 13 is a hardware block diagram showing the principal composition of a control system in the image forming apparatus.

FIG. 13 shows a hardware composition of a control system of the present image forming apparatus. As shown in FIG. 13, the control system of the present image forming apparatus comprises a CPU 6000, an operating panel 7000, a ROM

8000, an BEPROM 9, a RAM 1000, an image memory 1100, an interface 1200 and an external interface 1300.

The CPU 6000 interprets and executes the commands in the program. The operating panel 7000 is a panel at which the user of the image forming apparatus is able to ascertain the internal state of the image forming apparatus, and to make various settings relating to the operation of the image forming apparatus, and the like. For this purpose, an LCD-based display, various operating keys, or the like, are provided on the operating panel 7000.

The ROM 8000 is a read-only semiconductor memory for storing programs which are executed by the CPU 6000 . The EEPROM 9 is a ROM whose storage contents can be erased or rewritten, and the storage data in same is maintained, even when the power source is disconnected. The RAM 1000 is a semiconductor memory which can be read from or written to by designating a desired address. The image memory 1100 is a memory for storing data (print image data) to be printed by the image forming apparatus.

The interface 1200 has a function for controlling the input and output to the various electrical components, such as the sensors, motors, clutches, and the like, provided in the image forming apparatus, from the CPU 6000. The external interface 1300 has an interface function for interfacing between the image forming apparatus and a computer terminal of a user issuing a print request to the image forming apparatus.

Figure 14:
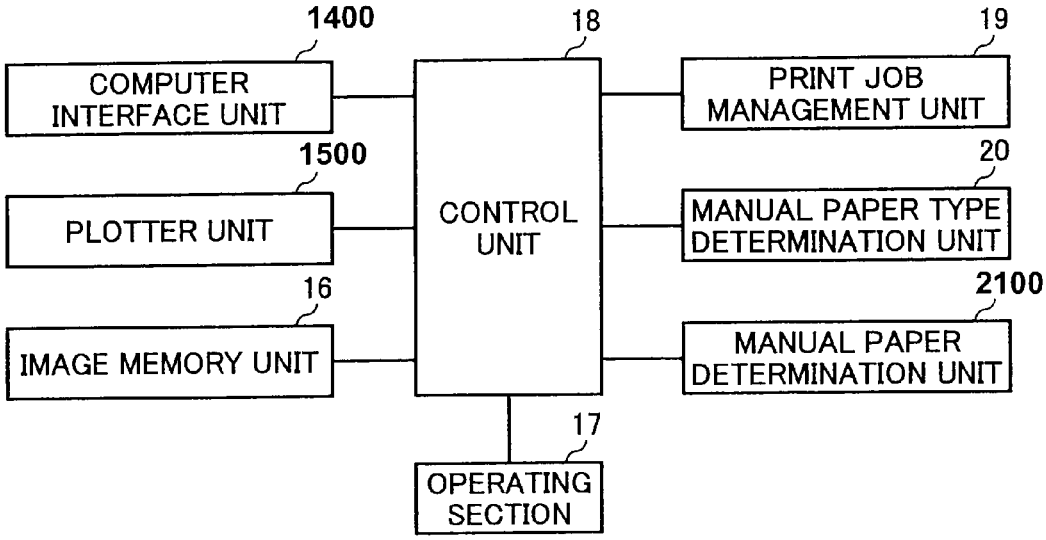
FIG. 14 is a block diagram showing the composition of the image forming apparatus.
Figure 15:
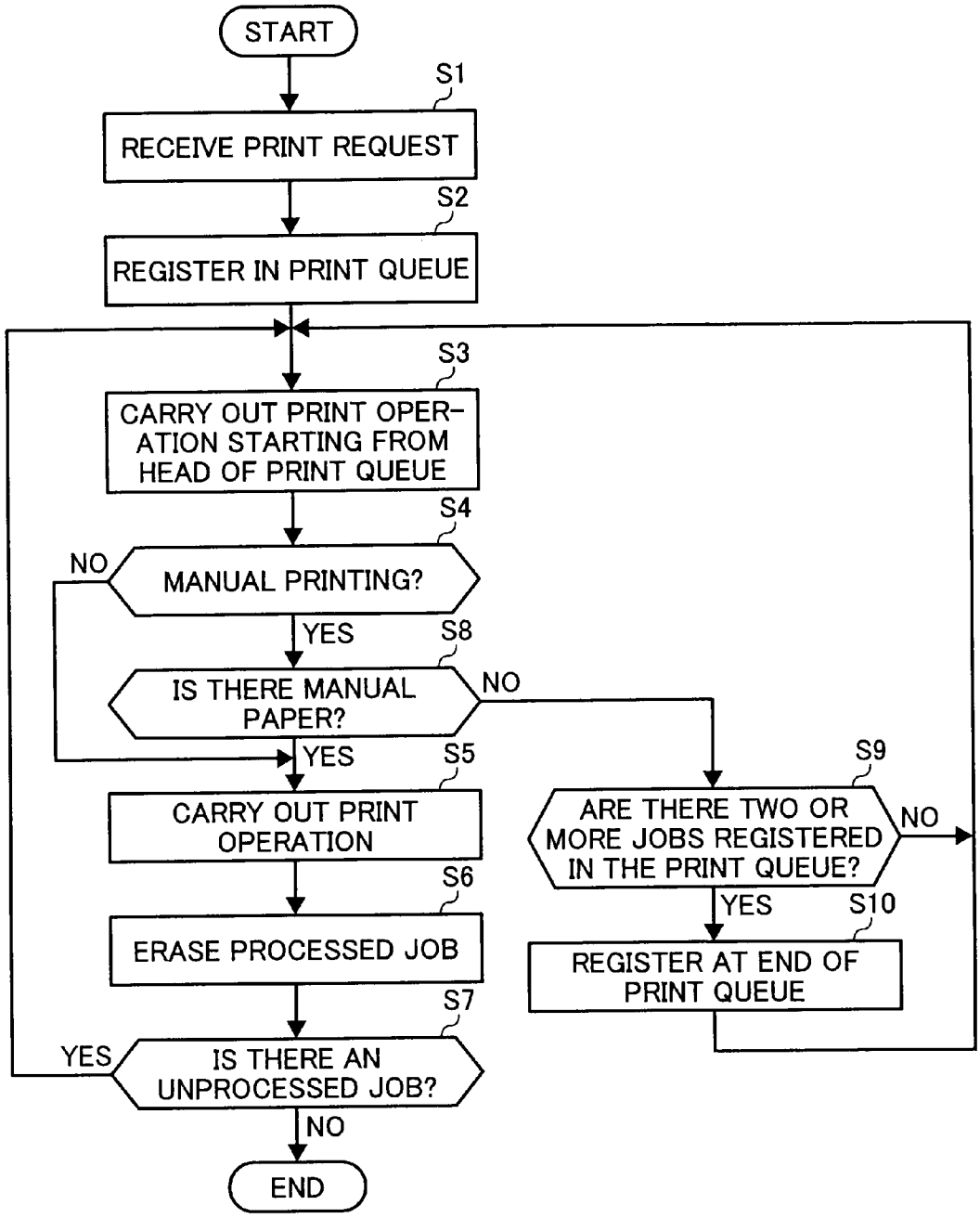
FIG. 15 is a flowchart showing the sequence of a first example of processing (a print control operation) relating to a print request in the image forming apparatus.

FIG. 14 shows the general composition of the image forming apparatus. The image forming apparatus comprises: a control unit 18, an operating unit 17, a computer interface unit 1400, a plotter unit 1500, an image memory unit 16, a print job management unit 19, a manual paper type detection unit 20, and a manual paper determination unit 2100.

The computer interface unit 1400 has a function for communicating with the computer terminal of a user issuing a print request to the image forming apparatus, and in FIG. 13, it corresponds to the external interface 1300. The plotter unit 1500 comprises photosensitive bodies 1-*a* to 1-*d* as shown in FIG. 12, LD apparatuses 3-*a* to 3-*d*, and an intermediate transfer belt 2, or the like, and by means of the image forming operation described above with reference to FIG. 12, it forms a corresponding image on the prescribed paper supplied from the main body paper supply unit 5 or the manual paper supply unit 4, in accordance with the print image data stored in the image memory unit 16.

The aforementioned print request includes: 1) print image data; 2) information relating to the paper supply tray; and 3) information relating to the paper size and paper type.

Of these, 1) the print image data is the actual data which is to be printed onto the prescribed paper. More specifically, it is document data, photo data, graphic data, or data combining these.

The information 2) relating to the paper supply tray is information for designating a paper supply tray, from amongst the paper tray provided in the manual paper supply unit 4 shown in FIG. 2, and the paper supply trays provided in the main body paper supply unit 5 which respectively accommodate standard papers of various sizes. When printing, paper is supplied from the paper tray designated by this information, and an image is then printed on the paper. By referring to this information 2) relating to the paper supply tray, it is possible to judge whether or not the corresponding print request relates to manual printing. In other words, if this information indicates the paper supply tray provided in the manual paper supply unit 4, then it is possible to judge that the corresponding print request relates to manual printing. On the other hand, if this information indicates a paper supply tray provided in the main body paper supply unit 5, then it is possible to judge that the corresponding print request is printing other than manual printing, in other words, printing onto standard paper which is installed inside the main body of the image forming apparatus.

3) The information relating to the paper size and paper type is information which indicates the specifications of the paper onto which the print image data is to be printed. More specifically, it may be, for example, a paper size of A3, A4, B4, B5, A5, A6, B6, or the like.

The image memory unit 16 is a memory which stores image data transmitted from the computer apparatus of a user issuing a print request to the image forming apparatus, and it corresponds to the image memory 1100 shown in FIG. 13. The operating section 17 has the function of displaying the state of the image forming apparatus, or receiving the input of operations from the user to the image forming apparatus, and it includes the operating panel 7000 shown in FIG. 13. The print job management unit 19 has the function of managing the sequence of execution of print jobs relating to print requests issued to the image forming apparatus, and it is realized by means of the CPU 6000 in FIG. 13 executing the commands of the program stored in the ROM 8000.

The manual paper type determination unit 20 determines the type of paper loaded in the manual paper supply unit 4 on the basis of measurement information obtained by measuring the transmissivity of the paper by means of the composition shown in FIG. 22, which is described below, or by measuring the reflectivity of the paper by means of a reflective sensor, or the like. The corresponding determination results are sent to the control unit 18. The manual paper size determination unit 21 has the composition shown in FIGS. 21A and 21B, and it determines the presence or absence of paper loaded in the manual paper supply tray 4, and the corresponding paper size, and sends the determination results to the control unit 18. The control unit 18 has the function of controlling the sequence of blocks described above, and it is realized by means of the CPU 6000 shown in FIG. 13 executing the program stored in the ROM 8000. B-12

With reference to figures 15 through 20B, there follows a step-by-step description of the sequence of operations according to a first example to a sixth example of print control operations, which are achieved by means of a program stored in the ROM 8000 800 being executed by a CPU 6000 that functions as a control unit 18 or a print job management unit 19 of the image forming apparatus.

It is presumed that the program stored in the ROM 8000 is written to the ROM 8000 in advance, upon shipment of the product, but the invention is not limited to an embodiment of this kind, and a composition may also be adopted in which the image forming apparatus has a hard disk device, for example, and a program is installed on this disk device by means of a portable recording medium, such as a CD-ROM, or a program is installed from an external server, via a communications network and the external interface 1300, whereupon the program is executed by the CPU 6000. A-6

Furthermore, in the print control operations of the image forming apparatus according to the respective examples described below, it is presumed that the image forming apparatus is connected communicably to the computer terminals of respective users by means of a communications network, such as a LAN, via the external interface 1300.

If it is determined by the computer interface unit 1400 of the image forming apparatus that a print request has been transmitted from the computer terminal of a user (step S1), then the corresponding print image data is stored in the image memory unit 16. Thereupon, in step S2, the corresponding print job is registered in a prescribed print queue, by the print job management unit 19.

In principle, the print jobs are registered in the print queue in the same order in which the print requests are received. In other words, each time a print request is received, it is registered in sequence after the previously registered print job. Furthermore, the execution of the registered print jobs also follows the same sequence, in other words, print jobs are executed in the same order in which the print jobs were registered. In other words, they are executed in order starting from the head of the print queue.

Thereupon, in the print job management unit 19, at step S3, the print job registered at the head of the print queue is selected.

The print queue is stored, maintained and managed in the EEPROM 9 by the CPU 6000 acting as a print job management unit 19, and it constitutes information for managing the sequence of the print jobs to be executed by the image forming apparatus.

The print queue is stored, maintained and managed in the EEPROM 9 by the CPU 6000 acting as a print job management unit 19, and it constitutes information for managing the sequence of the print jobs to be executed by the image forming apparatus.

At step S4, it is judged whether or not the current print job is a manual print job, on the basis of the information indicating the paper supply tray contained in the print request sent from the user's computer terminal. If, as a result of this, the print job is not a manual print job (NO at step S4), then the print job management unit 19 confirms that the plotter unit 1500 is in a print-enabled state, and then executes a print operation relating to the corresponding print job (step S5).

In this print operation, the print image data stored in the image memory unit 16 is output by printing onto the prescribed paper, in the plotter unit 1500, by means of an optimal operation according to the conditions contained in the print request from the user's computer terminal.

After completing the print operation, the corresponding print job is erased from the print queue at step S6, and at step S7, it is judged whether or not there is another print job registered in the print queue. If, as a result of this, there is no print job registered in the print queue, then the operation terminates. If, on the other hand, there is another registered print job, then the procedure returns to step S3, and the subsequently registered print job is selected.

If, on the other hand, the current print job is a manual print job (YES at step S4), then the presence or absence of paper in the manual paper supply unit 4 is judged by the manual paper size determination unit 21. If the result of this determination step is that there is no paper (NO at step S8), then at step S9, it is judged whether or not there are two or more print jobs registered in the print queue. If, as a result of this, there is only one print job registered (NO), then the procedure returns to step S3, and the loop of steps S3, S4, S8, S9 is repeated. In other words, in this case, the loop of steps S3, S4, S8, S9 is repeated until paper is loaded into the manual paper supply unit 4 and the paper is detected by the manual paper size determination unit 21. During this time, a print operation is not carried out by the image forming apparatus.

If, on the other hand, there are two or more print jobs registered in the print queue, as a result of the determination step at S9, then at step S10, the position in the queue of the corresponding print job is moved to the last position. In other words, the corresponding manual print job is registered at the end of the print queue. Subsequently, the procedure returns to step S3.

In this case, by changing the positions of the registered print jobs in the print queue as described above, the print job that was registered in second place before the change becomes placed at the head of the print queue, after the change. Thereupon, the processing in step S4 onwards is carried out for this print job. In other words, if the print job which has been newly placed at the head of the queue is not related to manual printing, then at step S5, a print operation is carried out for that job, but if it does relate to manual printing, then at step S8, it is again judged whether or not paper is present in the manual paper supply unit 4. If, as a result of this, paper is not detected, then the procedure advances to step S9, and the loop of steps S10, S3, S4, S8, S9 is repeated thereafter, until paper is loaded into the manual paper supply unit 4.

If, on the other hand, the user loads paper into the manual paper supply unit during any of the loop operations described above, then when this paper is detected (YES at step S8), at step S5, the print operation relating to the print job selected immediately previously at step S3 will be executed. Thereupon, a similar operation to that described above is repeated.

In a first example of a print control operation of the image forming apparatus described above, as illustrated in FIG. 15, even if the user makes a print request to the image forming apparatus from his or her computer terminal in a state where there is no paper in the manual paper supply unit 4, then until paper is loaded into the manual paper supply unit 4 by the user, it is still possible to print with paper from the other trays provided in the main body paper supply unit 5, in other words, to execute print jobs other than print jobs relating to manual printing. Consequently, the effects of printing from trays other than the manual paper supply unit 4, in other words, the effects on the execution of print jobs other than print jobs relating to manual printing, is minimized, and the work required of the user carrying out a print job relating to manual printing can be reduced.

In other words, a user who issues a print request relating to manual printing is not required to make two round-trips between his or her own computer terminal and the image forming apparatus in order to carry out printing, namely, loading paper in advance in the manual paper supply unit 4 of the image forming apparatus, returning to his or her computer terminal to issue the print request, and then going back to the image forming apparatus to pick up the paper after printing. More specifically, the user inputs the corresponding print request at his or her computer terminal, and then loads paper in the manual paper supply unit of the image forming apparatus, and when this is detected by the manual paper determination unit 2100 (YES at step S8), then the corresponding print operation is carried out (step S5). Accordingly, the user only needs to make one round trip between his or her computer terminal and the image forming apparatus. Consequently, the working efficiency of the user can be improved.

In the case of the first example of a print control operation of the image forming apparatus as described above, if a plurality of print jobs relating to manual print requests have been registered in the print queue (YES at step S9), then before the paper is loaded into the manual paper supply unit 4 (NO at step S8), the ioop of steps S10, S3, S4, S8, S9 is repeated as described above. Consequently, when a user who has issued a print request relating to manual printing has loaded paper into the manual paper supply unit 4 of the image forming apparatus (YES at step S8), the print job corresponding to that paper will not necessarily have been selected at the step S3 carried out immediately previously.

Alternatively, if there is a difference between the sequence of the manual print requests issued by a plurality of users from respective computer terminals, and the sequence in which these users actually load paper into the image forming apparatus and obtain a print result, then the respective users will not be able to obtain print results which match the manual print requests that they issued.

In the print control operation for the image forming apparatus according to the second example which is described below, each time that a manual print request is issued from a user's computer terminal, the image forming apparatus receiving the request issues an ID (identification information) corresponding to the manual print request, for the corresponding computer terminal, and it sends this ID to the corresponding computer terminal. When the user has loaded paper into the manual unit 4 of the image forming apparatus, he or she can then indicate the corresponding ID. Consequently, in cases where a plurality of users have issued different manual print requests to a common image forming apparatus, then even if the corresponding print job is not positioned at the head of the print queue of the image forming apparatus when the user loads paper and stands in front of the image forming apparatus in order to obtain the print result, by means of the user indicating the ID, it is possible to make the image forming apparatus carry out the corresponding print operation, at that time. Therefore, each of the users is reliably able to obtain print results which match their own manual print requests.

The sequence of the print control operation of the image forming apparatus according to the second example is now described with reference to FIG. 16A and 16B.

When it is detected by the computer interface unit 1400 of the image forming apparatus that a print request has been sent from a user's computer terminal (step S21), then corresponding print data is stored in the image memory section 16.

In the print control operation according to this second example, when it is detected by the computer interface unit 1400 of the image forming apparatus that a print request has been generated in this way (YES at step S22), then if it is judged by the print job management unit 19 that the print request is one relating to manual printing, on the basis of the paper supply tray information included in the print request, a manual print ID is generated. This manual print ID is reported by the computer interface unit 14 to the computer terminal which issued the manual print request (step S23).

The ID reported here is generated when a manual print request occurs, and it is erased when the corresponding manual print operation has been completed. When a new print request relating to manual printing arises, then a new ID is assigned to that request. At step S24, the corresponding print job is registered in the prescribed print queue by the print job management unit 19. Thereupon, in step S25, the print job management unit 19 selects the print job registered at the head of the print queue.

At step S26, it is judged whether or not the print job is a manual print job, on the basis of the information indicating the paper supply tray relating to that print job, as included in the print request sent from the user's computer terminal. If, as a result of this, the job is not a manual print job (NO at step S26), then provided that the plotter unit 1500 is in a print-enabled state, the print job management unit 19 starts a print operation relating to the corresponding print job (step S27).

In this print operation, similarly to the case of the print control operation according to the first example described above, the print image data stored in the image memory unit 16 is output by printing onto prescribed paper in the plotter unit 1500, by an optimal operation in accordance with the conditions included in the print request from the user's computer terminal. When the print operation has completed, at step S28, the corresponding print job is erased from the print queue, and at step S29, it is judged whether or not there is another print job registered in the print queue. If, as a result of this, there is no print job registered in the print queue, then the operation ends. If, on the other hand, there is still a registered print job, then the procedure returns to step S25, and the next registered print job is selected.

If, on the other hand, the print job is a manual print job (YES at step S26), then the manual paper size determination unit 21 judges the presence or absence of paper in the manual paper supply unit 4, and if there is no paper (NO at step S30), then at step S35, it judges whether or not there are two or more print jobs registered in the print queue. If, as a result of this, there is only one registered print job (NO), then the procedure returns to step S25, and the loop of steps S25, S26, S30, S35 is repeated. In other words, in this case, the loop of steps S25, S26, S30, S35 is repeated until paper is loaded in the manual paper supply unit 4 and detected by the manual paper size determination unit 21. During this time, a print operation is not carried out in the image forming apparatus.

If, on the other hand, as a result of the determination step in S35, there are two or more jobs registered in the print queue, then at step S36, the corresponding print job is moved to the last position in the queue. In other words, the corresponding manual print job is registered at the end of the print queue. Thereupon, the procedure returns to step S25. In this case, by changing the positions of the registered print jobs in the print queue in this way, a print job which was registered in second position before the change becomes registered at the head of the queue, after the change. The processing from step S26 onwards is then carried out for this print job.

In other words, if the print job newly placed at the head of the queue does not relate to manual printing, then a print operation is carried out for this job at step S29, whereas if it does relate to manual printing, then at step S30, it is judged again whether or not paper is present in the manual paper supply unit 4. If, as a result of this, paper is not detected, then the procedure advances to step S35, and the loop of step S36, S25, S26, S30, S35 is repeated thereafter until paper is loaded into the manual paper supply unit 4.

On the other hand, if the user loads paper into the manual paper supply unit during any of the loop operations described above, then when this is detected by the manual paper size determination unit 21 (YES at step S30), all of the currently existing manual print IDs which have been created at step S23 are displayed on the operating section 17 (step S31), When the user looks at this display and indicates a manual print ID via the operating section 17 (step S32), then the print job of the corresponding ID is selected from the print queue and this job is executed (steps S33, S34, S27). In other words, in this case, it is judged whether or not the print job corresponding to the ID indicated by the user at step S32 is at the head of the print queue (step S33). If the result of this is YES, then the corresponding print operation is carried out at step S27. If this is not the case (NO at step S33), then at step S34, the corresponding print job is inserted at the head of the print queue, and at step S27, a print operation corresponding to the print job is carried out. Thereupon, an operation similar to that described above is repeated.

According to the print control operation of the image forming apparatus according to this second example, when a manual print request is received from a user's computer terminal, a corresponding ID is reported from the image forming apparatus to that computer terminal, and the user is then able to indicate that ID when he or she has loaded paper in the manual paper supply unit 4 of the image forming apparatus. Consequently, the user is able reliably to obtain the print results intended by the user.

Next, a print control operation for the image forming apparatus according to a third example will be described with reference to FIGS. 17A and 17B.

In this example, in contrast to the second example, instead of reporting an ID corresponding to a manual print request and having the user indicate this ID when executing the corresponding print operation, the size and type of the paper loaded in the manual paper supply unit 4 are automatically determined, and control is implemented in such a manner that a print operation corresponding to a print request matching the determined paper size and paper type is automatically selected.

By implementing control of this kind, it is possible to omit the task of the user who is implementing the manual printing having to indicate an ID relating to that print request. Therefore, the working efficiency of the users can be improved.

Below, the sequence of a print control operation for a image forming apparatus according to this third example will be described with reference to FIGS. 17A and 17B.

When the computer interface unit 1400 of the image forming apparatus determines that a print request has been sent from a user's computer terminal (step S41), then the corresponding print data is stored in the image memory unit 16. At step S42, the corresponding print job is registered in the prescribed print queue by the print job management unit 19. Thereupon, at step S43, the print job management unit 19 selects the print job registered at the head of the print queue. At step S44, it is judged whether or not the print job is a manual print job, from the information indicating the paper supply tray relating to that print job, as included in the print request sent from the user's computer terminal. If, as a result of this, the print job is not a manual print job (NO at step S44), then provided that the plotter unit 1500 is in a print-enabled state, the print job management unit 19 starts a print operation relating to the print job (step S45).

Similarly to the case of the print control operation according to the first example, in this print operation, the image data stored in the image memory unit 16 is output by printing onto prescribed paper by the plotter unit 1500, by an optimal operation in accordance with the conditions contained in the print request from the user's computer terminal.

When the print operation has finished, at step S46, the corresponding print job is erased from the print queue, and it is judged whether or not there is a print job registered in the print queue at step S47. If, as a result of this, there is no print job registered in the print queue, then the operation terminates. If, on the other hand, there is still a registered print job remaining, then the procedure returns to step S43 and the next registered print job is selected.

Alternatively, if the print job is a manual print job (YES at step S44), then it is judged by the manual paper size determination unit 21 whether or not paper is present in the manual paper supply unit 4, and if there is no paper (NO at step S48), then at step S54, it is judged whether or not there are two or more print jobs registered in the print queue. If, as a result of this, there is only one registered print job (NO), then the procedure returns to step S43, and the loop of steps S43, S44, S48, S54 is repeated. More specifically, in this case, the loop of steps S43, S44, S48, S54 is repeated until paper is loaded into the manual paper supply unit 4 and the paper is detected by the manual paper size determination unit 21. During this, a print operation is not performed in the image forming apparatus.

Meanwhile, if there are two or more registered jobs in the print queue, as a result of the judgment at step S54, then at step S55, the print job in question is moved to the last position in the print queue. In other words, the corresponding manual print job is registered at the end of the print queue. The procedure then returns to step S43. In this case, similarly to the example described above, by changing the positions of the print jobs registered in the print queue, the print job that was registered in second place before the change becomes positioned at the head of the queue after the change. The processing from step S44 onwards is then carried out in respect of this print job.

In other words, if the print job newly placed at the head of the queue does not relate to manual printing, then a print operation is carried out for that job at step S45, whereas if it does relate to manual printing, then at step S48, it is judged whether or not paper is present in the manual paper supply unit 4. If, as a result of this, no paper is detected, then the procedure advances to step S43, and the loop of steps S43, S44, S48, S54, S55 is repeated thereafter until paper is loaded into the manual paper supply unit 4.

If, on the other hand, the user loads paper into the manual paper supply unit during one of the loop operations described above, and this paper is detected by the manual paper size determination unit 21 (YES at step S48), then in this third example, at step S49, the size and type of the paper loaded into the manual paper supply unit 4 are determined. This determination process is carried out by the composition shown in FIGS. 21A, 21B and 22, which are described hereinafter, or the like (the paper type determination unit 20 and the manual paper determination unit 2100 shown in FIG. 14).

Thereupon, at step S51, the paper size and paper type specification information relating to manual print requests, which has been received from users' computer terminals and is contained in the print requests relating to manual printing registered in the print queue, is compared with the paper size and paper type of the paper actually loaded in the manual paper supply unit 4, as determined at step S50. If, as a result of this, the print queue contains a print job relating to a manual print request which matches the determined paper size and paper type (YES at step S51), then at step S52, it is judged whether or not the print job matching the determined information is at the head of the print queue (step S52). If, the result of this is YES, then at step S45, the corresponding print operation is implemented. However, if this is not the case (NO at step S52), then at step S53, the corresponding print job is inserted at the head of the print queue, and at step S45, a corresponding print operation is executed for that print job. Thereafter, a similar operation to the foregoing is repeated.

If, on the other hand, it is judged that there is no print job matching the information determined by the determination step in S51 (NO), then the procedure moves to step S54, and the following operations are executed. More specifically, if there is one job registered in the print queue (NO at step S54), then since there is a strong possibility that the user has loaded the wrong paper, the steps S43, S44, S48 are performed, and at step S49, the paper size and paper type are determined once again and are compared with the registered job at step S50. If the user has loaded the correct paper during this time (YES at step S51), then the processing from step S52 onwards as described above is carried out.

If, on the other hand, there are a plurality of jobs registered in the print queue (YES at step S54), then at step S55, the job sequence is provisionally changed and processing for the next print job in the sequence is carried out. When this processing has ended, if, at step S43, processing is restarted for the print job that was provisionally delayed in the sequence of the print queue (step S43), then at step S49, the paper size and paper type are determined again and compared with the registered job at step S50. If the user has loaded the correct paper during this time (YES at step S51), then the aforementioned processing from step S52 onward is carried out.

Furthermore, apart from the situations described above, a NO result may occur at step S51 in a case where a user has loaded paper in advance and then issued the corresponding print request subsequently. In cases of this kind, a loop of step S54, S43, S48, S49, S50, S51 is repeated until the corresponding print request is carried out. Alternatively, if this print job is delayed in the print queue sequence at step S55, and a subsequent job is implemented (steps S55, S43, S44, S45, S46, S47), then the determination and comparison processes described above are carried out again thereafter (step S43, S44, S48, S49, S50).

If, during this time, a corresponding print request has been issued and registered in the print queue, then the result at step S51 becomes YES, and thereafter, the processing from step S52 onwards is carried out for the corresponding print job.

In the case of the third example, although omitted from the drawings, if there are a plurality of manual print jobs which match the paper size and paper type determined at step S50, then printing is carried out for the job that was request first.

According to this third example, when paper is loaded in the manual paper supply unit 4 by the user, the paper size and paper type are determined automatically, and manual printing which matches the determined paper information is carried out automatically. Consequently, the user carrying out manual printing is spared the work of having to indicate an ID, or the like.

In the case of the print control operation for an image forming apparatus according to the third example described above, in cases where there are a plurality of manual print requests having the same paper size and paper type specifications, as described above, then if there is a difference between the order in which the manual print requests are received from the users' computer terminals, and the order in which the users actually load paper into the image forming apparatus, it will not be possible for the users to obtain the print results they desired. More specifically, if there are a plurality of print jobs in the print queue which have the same paper size and paper type specifications, as described above, then print operations are performed according to the order in the print queue, in other words, in the same order in which the corresponding print requests were received. Therefore, if a user whose print request was received later goes to the image forming apparatus earlier and loads paper for his or her print request in the manual paper supply unit first, then in fact, a print operation relating to another print job, whose print request was received earlier, will be carried out.

In order to resolve the aforementioned problem, in the print control operation for an image forming apparatus according to a fourth example, which is described below, similarly to the print control operation according to the second example which was described above with reference to FIGS. 16A and 16B, when a manual print request is received, a corresponding ID is returned, and if there are a plurality of manual print requests designating the same paper size and the same paper type, then when loading paper in the manual paper supply unit 4, the user is able to indicate the corresponding ID. Therefore, even if there are a plurality of print jobs which match the information determined for the paper loaded in the manual paper supply unit 4, it is still possible for users reliably to obtain the print results they desire.

The print control operation for an image forming apparatus relating to the fourth example is described below with reference to FIGS. 18A and 18B.

When it is detected by the computer interface unit 1400 of the image forming apparatus that a print request has been sent from a user's computer terminal (step S61), then if the print job management unit 19 has judged on the basis of the paper supply tray information included in the corresponding print request that the print request relates to manual printing (YES at step S62), it generates a manual print ID. Thereupon, the computer interface unit 1400 reports this manual print ID to the computer terminal which issued the manual print request (step S63).

Similarly to the foregoing, the ID reported here is generated when manual printing occurs, and it is erased when manual printing is completed. If another new print request relating to manual printing is generated, then a new ID is assigned in respect of this request. At step S64, the corresponding print job is registered in the prescribed print queue by the print job management unit 19. Thereafter, at step S65, the print job management unit 19 selects the print job registered at the head of the print queue.

At step S66, it is judged whether or not the print job is a manual print job, on the basis of the information indicating the paper supply tray relating to the print job, as contained in the print request sent by the user's computer terminal. If, as a result of this, the print job is not a manual print job (NO at step S66), then provided that the plotter unit 1500 is in a print-enabled state, the print job management unit 19 starts a print operation relating to the corresponding print job (step S67).

Similarly to the case of the print control operation according to the first example described above, in this print operation, the image data stored in the image memory unit 16 is output by printing onto prescribed paper by the plotter unit 1500, by means of an optimal operation in accordance with the conditions contained in the print request from the user's computer terminal.

When the print operation has completed, at step S68, the corresponding print job is erased from the print queue, and at step S69, it is judged whether or not a print job has been registered in the print queue. If, as a result of this, there is no print job registered in the print queue, then this operation terminates. If, on the other hand, there is a registered print job still remaining, then the procedure returns to step S65, and the next registered print job is selected.

Alternatively, if the print job is a manual print job (YES at step S66), then the manual paper size determination unit 21 judges whether or not paper is present in the manual paper supply unit 4, and if there is no paper (NO at step S70), then at step S79 it is judged whether or not there are two or more print jobs registered in the print queue. If, as a result of this, there is only one registered print job (NO), then the procedure returns to step S65, and the loop of steps S65, S66, S70, S79 is repeated. In other words, in this case, the loop of steps S65, S66, S70, S79 is repeated until paper is loaded in the manual paper supply unit 4 and that paper is detected by the manual paper size determination unit 21. During this time, a print operation is not carried out in the image forming apparatus.

If, on the other hand, there are two or more jobs registered in the print queue as a result of the judgment step in S79 (YES), then at step S80, the corresponding print job is moved to the last position in the print queue. In other words, the corresponding manual print job is registered at the end of the print queue. Thereupon, the procedure returns to step S65. In this case, by changing the positions of the registered print jobs in the print queue as described above, the print that was registered in second place before the change becomes positioned at the head of the queue, after the change. The processing in step S66 onwards is then carried out in respect of this print job. More specifically, if the print job newly placed at the head of the queue does not relate to manual printing, then a print operation is carried out for that job at step S67, whereas if the job does relate to manual printing, then at step S70 it is judged once again whether or not paper is present in the manual paper supply unit 4. If, as a result of this, paper is not detected, then the procedure advances to step S79, and thereafter, the ioop of steps S65, S66, S70, S79, S80 is repeated until paper is loaded into the manual paper supply unit 4.

If, on the other hand, paper is loaded into the manual paper supply unit during one of the loop operations described above, and this paper is detected by the manual paper size determination unit 21 (YES at step S70), then similarly to the third example described above, the paper size and paper type loaded in the manual paper supply unit 4 is determined at step S71.

In step S72, the paper size and paper type specification information relating to that manual print request, as contained in the print request relating to manual printing registered in the print queue, is compared with the paper size and paper type of the paper actually loaded in the manual paper supply unit 4, as determined at step S71. If, as a result of this, the print queue contains a print job relating to a manual print request which matches the determined paper size and paper type (YES at step S73), then at step S74, it is judged whether or not there are a plurality of corresponding print jobs. If there are a plurality of print jobs (YES at step S74), then the IDs relating to the plurality of print jobs are displayed on the operating section 17 (step S75). When the user has viewed these and indicated an ID via the operating section 17 (step S76). The print job having the corresponding ID is extracted from the print queue and it is executed (steps S77, S78, S67).

In other words, in this case, it is judged whether or not the print job corresponding to the ID indicated by the user at step S76 is positioned at the head of the print queue (step S77). If the result of this is YES, then a corresponding print operation is carried out at step S67. On the other hand, if this is not the case (NO at step S77), then at step S78, the corresponding print job is inserted at the head of the print queue, and at step S67, a print operation corresponding to that print job is carried out. Thereafter, similar processing to the foregoing is repeated.

If, as a result of the judgment step at S73, it is determined that there is no print job matching the determined information (NO), then similarly to the case of the third example, the procedure moves to step S79, and the operation from that step onwards is carried out. More specifically, if there is one job registered in the print queue (NO at step S79), then since there is a strong possibility that the user has loaded the wrong paper, the steps S65, S66, S70 are performed, and at step S71, the paper size and paper type are determined once again and are compared with the registered job at step S72. If the user has loaded the correct paper during this time, then the judgment becomes YES at step S74, and the processing from step S77 onwards as described above is carried out.

If, on the other hand, there are a plurality of jobs registered in the print queue (YES at step S79), then at step S80, the job sequence is provisionally changed and processing for the next print job in the sequence is carried out. When this processing has ended, if, at step S65, processing is restarted for the print job that was provisionally delayed in the sequence of the print queue, then at step S71, the paper size and paper type are determined again and compared with the registered job at step S72. If the user has loaded the correct paper during this time (YES at step S73), then the aforementioned processing from step S74 onward is carried out.

Furthermore, apart from the situations described above, a NO result may occur at step S73 in a case where a user has loaded paper is advance and then issued the corresponding print request subsequently. In cases of this kind, a loop of steps S79, S65, S66, S70, S71, S72, S73 is repeated until the corresponding print request is carried out. Alternatively, the print job is delayed in the print queue sequence at step S80, a subsequent job is implemented (steps S80, S65, S66, S67, S68, S69), and the determination and comparison processes described above are then carried out again thereafter (steps S65, S66, S70, S71, S72).

If a corresponding print request has been made and registered in the print queue during this time, then the result at step S73 will become YES, and thereafter, the processing from step S74 will be carried out for the corresponding print job.

According to the print control operation of the image forming apparatus according to this fourth example, when a manual print request is received from the user's computer terminal, a corresponding ID is reported from the image forming apparatus to the computer terminal. If the user then loads paper into the manual paper supply unit 4 of the image forming apparatus, the paper size and paper type of that paper are determined, and if there are a plurality of print jobs relating to print requests which specify the same paper size and the same paper type, then the IDs of these jobs are displayed on the operating section 17 of the image forming apparatus.

Therefore, by means of the user specifying an ID corresponding to his or her own print request, at the operating section 17 of the image forming apparatus, the corresponding print job is extracted from the print queue and a print operation is executed for that job. Consequently, the work required of a user performing manual printing is reduced, and hence the working efficiency of the user is improved, while at the same time, the user is able reliably to obtain the print results that he or she desires.

In the print control operations for an image forming apparatus according to the first to fourth examples described above, if print jobs are being performed in a continuous fashion from trays other than the manual paper supply unit 4, in other words, if printing using paper supplied from the main body paper supply unit 5, namely, print jobs that are not related to manual printing, are being performed continuously, then a user who has issued a manual print request will not be able to start manual printing even if he or she has loaded paper into the manual paper supply unit 4, and a waiting time will occur.

On the other hand, since the number of sheets printed by manual printing is generally small, then even if, for example, print processing is temporarily halted during the course of continuous print jobs and if a manual print job is inserted and carried out, there is little possibility that this will cause discontent to the user relating to the aforementioned continuous printing jobs.

In the print control operation for an image forming apparatus according to a fifth example which is described below with reference to FIGS. 18A and 18B, when a manual print request arises, then even if a plurality of print jobs relating to other print requests, in other words, print jobs based on paper supply from the main body paper supply unit 5, are in the course of being implemented in a continuous fashion, the sequence of print jobs that are in progress is halted temporarily at a divide between print jobs. Thereupon, interrupt control becomes possible, in other words, control whereby the print operation relating to the manual print request is carried out preferentially. A composition is adopted in which s the user who has issued the manual print request can select and specify, as he or she wishes, whether or not to apply this interrupt control, via the operating section 17 of the image forming apparatus.

In this fifth example, firstly, the user who has issued the manual print request causes a "manual print preference selection screen" to be displayed by performing a prescribed operation on the operating section 17 of the image forming apparatus, and the user makes a setting for "Give/Do not give priority to manual printing", on this screen.

Figure 19A:
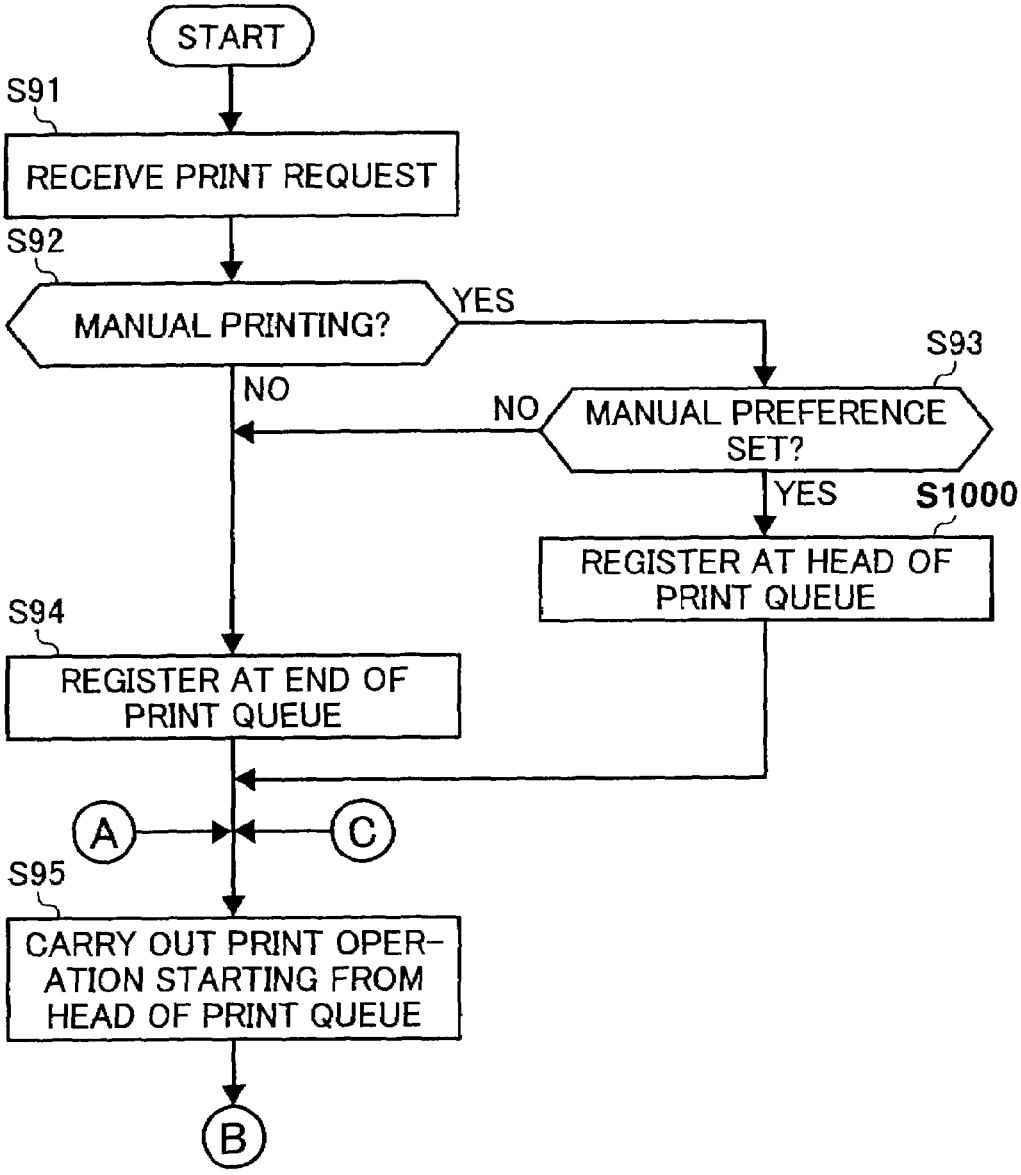
FIGS. 19A and 19B are flowcharts showing the sequence of a fifth example of processing (a print control operation) relating to a print request in the image forming apparatus.
Figure 19B:
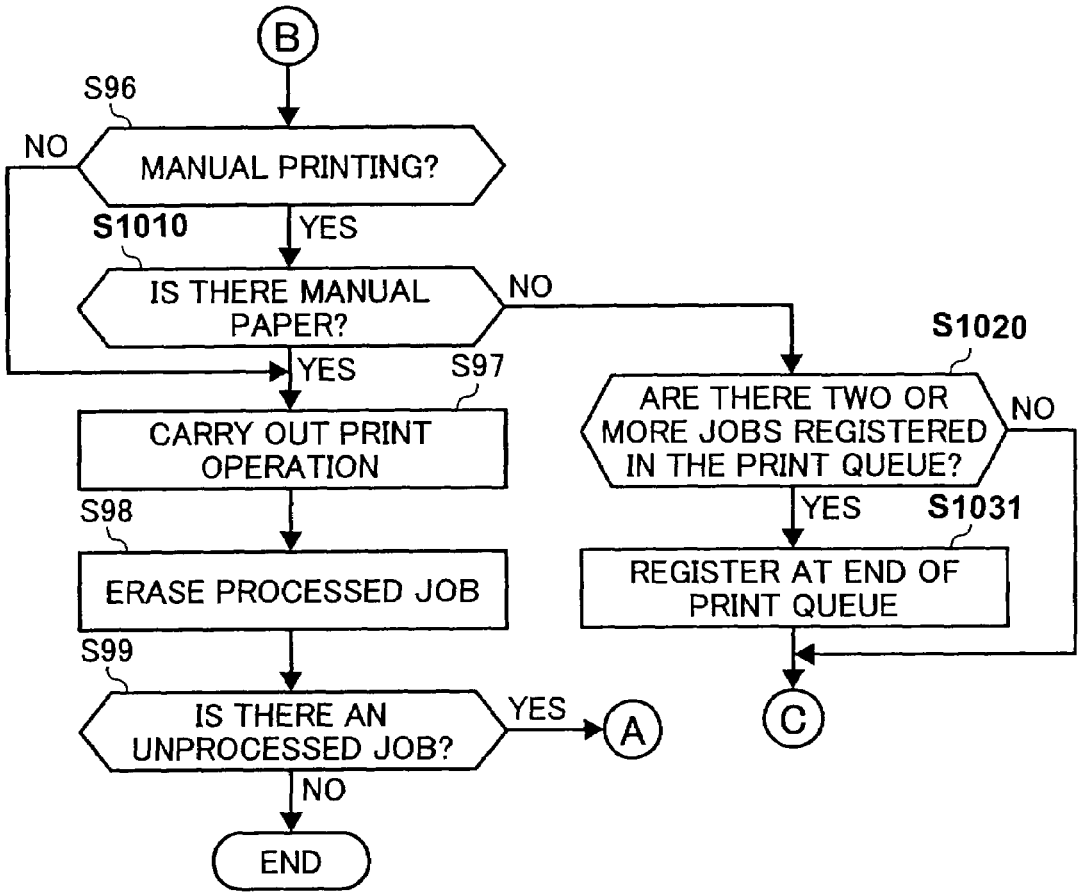

In FIGS. 19A and 19B, if the computer interface unit 1400 of the image forming apparatus has determined that a print request has been sent from the user's computer terminal (step S91), then the corresponding print data is stored in the image memory unit 16. At the next step S92, it is judged whether or not this print request relates to manual printing, on the basis of the information relating to the paper supply tray contained in the print request. If, as a result of this, the print request does not relate to manual printing (NO at step S92), then at step S94, a corresponding print job is registered in the prescribed print queue by the print job management unit 19. In principle, the job is registered in the queue after the previously registered jobs.

On the other hand, if the print request relates to manual printing (YES at step S92), then at step S93, it is judged whether or not the aforementioned setting for "Give/Don't give priority to manual printing" has been set to "Give priority", in other words, whether or not the manual print preference setting has been made. If, as a result of this, the setting is "Don't give priority" (NO at step S93), then similarly to the foregoing, at step S94, the corresponding print job is registered in the prescribed print queue by the print job management unit 19. In principle, the job is registered after the previously registered jobs. If, on the other hand, the result of the judgment at step S93 is "Give priority", then in contrast to the aforementioned principle, the print job corresponding to the step S1000 is registered at the head of the print queue. Thereafter, step S95 is carried out.

Consequently, in this case, after completing the print job that is currently in progress, the processing from step S96 onwards is carried out in respect of the print job relating to the manual print request that has been registered at the head of the print queue in step S1000.

In step S96 and subsequent steps, similar operations are carried out to those in steps S4 to Sl0 of the print control operation according to the first example, which was described above with reference to FIG. 15. The operations in steps S96, S97, S98, S99, Sl010, S1020, S1030 correspond respectively to the steps S4, S5, S6, S7, S8, S9, S10 described above with reference to FIG. 15.

In this way, according to the fifth example, when a user has made a manual print request, then if the manual printing preference setting described above has been made, the print job relating to the manual print request is registered at the head of the print queue, and therefore, when the print job currently in progress has been completed, the manual print request is carried out preferentially. Consequently, the user who made the manual print request is able to implement a print operation relating to a manual print request, preferentially, without having to wait for all of the print jobs relating to print requests that were registered before that print request to be completed. Therefore, the working efficiency of a user who is carrying out manual printing is improved.

The composition for preferentially implementing a manual print request is not limited to that of the present example; for instance, a composition may be adopted in which, when paper has been loaded into the manual paper supply unit 4 by the user, then if the aforementioned manual print preference setting has been made, upon completion of the print job currently in progress, a search for a manual print request is made starting from the head of the print queue and a manual printing operation for the located manual print request is carried out.

In this way, according to the fifth example, a user who has made a manual print request is able to make a setting indicating whether or not manual printing is to be carried out preferentially over other print jobs which are already registered in the print queue. Consequently, it is possible to provide optimal operation in accordance with the environment in which the image forming apparatus is used.

The manual printing preference setting was described above as being made by the user issuing the manual print request, but the invention is not limited to this example, and it is also possible for this setting to be made by the administrator of the image forming apparatus, for example. If a plurality of manual print requests have been made, then there is a possibility that the memory of the image forming apparatus may become insufficient.

In the print control operation for an image forming apparatus according to the sixth example described below, the problem described above is resolved by adopting a method where, when a manual print request arises, the print image data relating to that print request is not written to the memory of the image forming apparatus until paper is loaded in the manual paper supply unit 4 of the image forming apparatus by the user.

Below, the sequence of the print control operation for an image forming apparatus according to the sixth example is described with reference to FIGS. 20A and 20B.

Figure 20A:
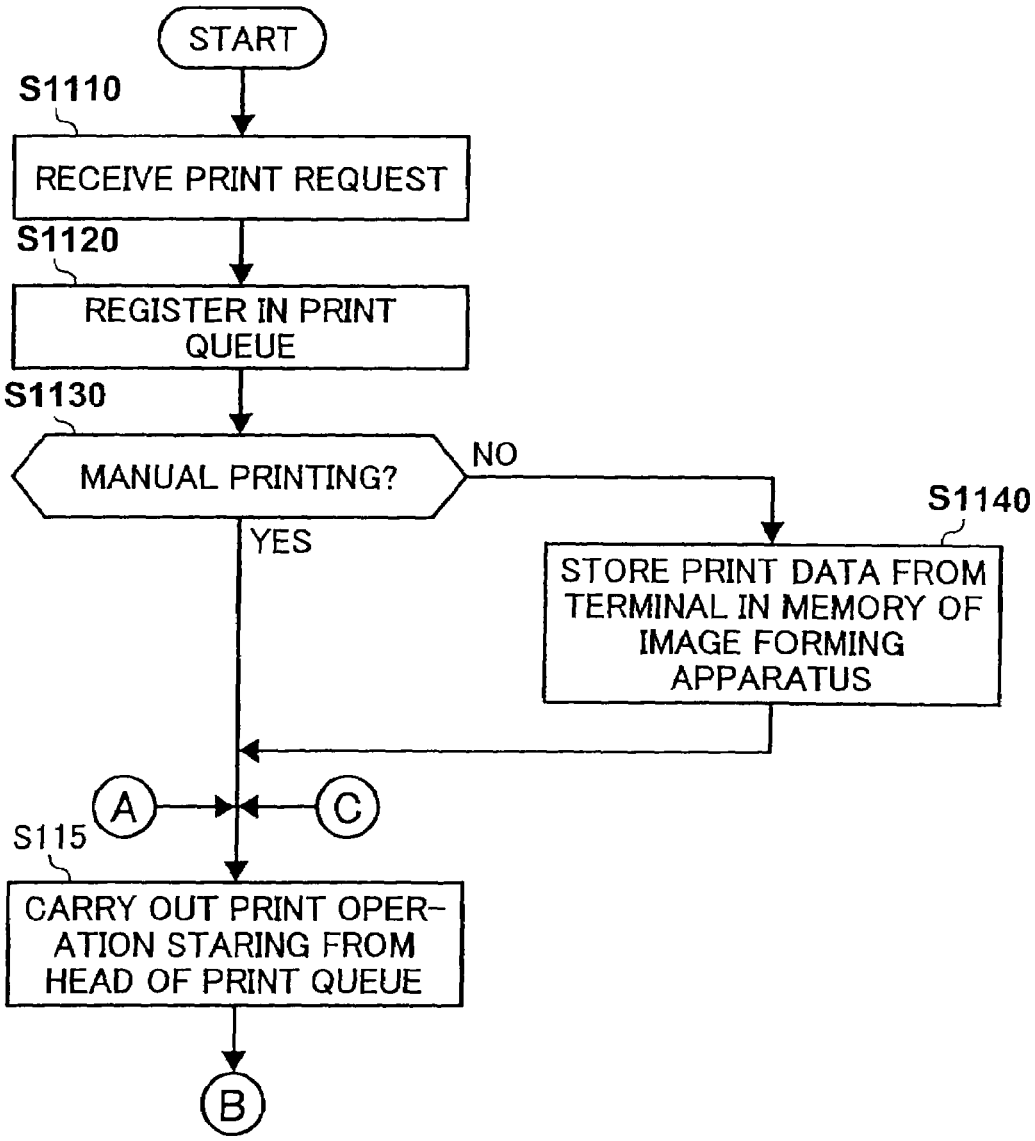
FIGS. 20A and 20B are flowcharts showing the sequence of a sixth example of processing (a print control operation) relating to a print request in the image forming apparatus.
Figure 20B:
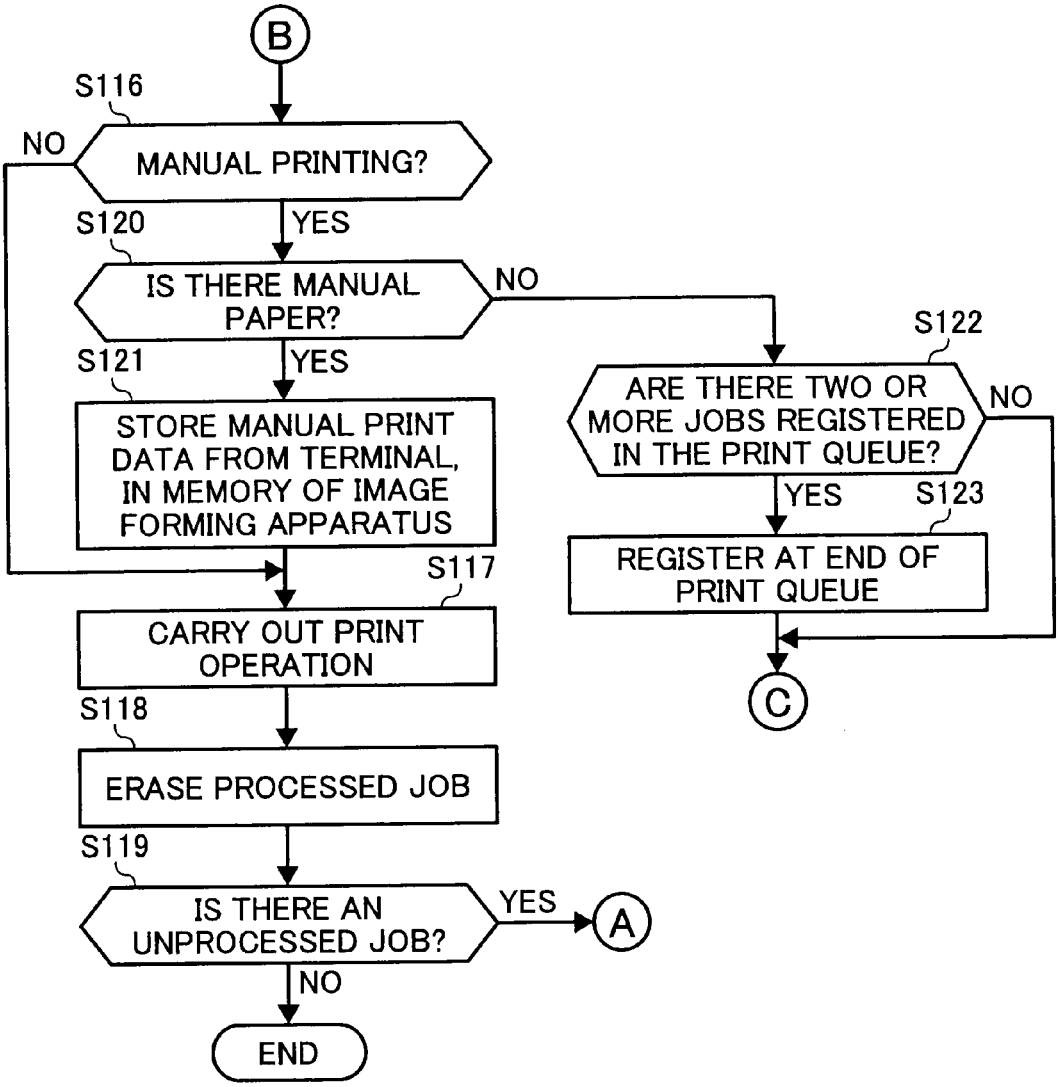

In FIGS. 20A and 20B, when the computer interface unit 1400 of the image forming apparatus detects that a print request has been transmitted by the computer terminal of a user (step S1110), then at step S1120, a corresponding print job is registered in the print queue by the print job management unit 19.

Thereupon, at step S1130, the print job management unit 19 judges whether or not the print request relates to manual printing, on the basis of the information relating to the paper supply tray for that print request as transmitted by the user's computer terminal. If, as a result of this, the print request does relate to manual printing (YES at step S113), then the contents of the manual print request (paper size, paper type, etc.), and information relating to the user computer terminal that issued this manual print request, are registered in the print queue of the print job management unit 19. Here, the print image data relating to the manual print request is still located in the computer terminal of the corresponding user, and it is not stored in the image memory unit 16 of the image forming apparatus.

On the other hand, if the print request does not relate to manual printing (NO at step S1130), then at step S1140, the corresponding print image data is acquired from the computer of the user who issued the request, via the computer interface unit 1400, and this print image data is stored in the image memory unit 16 (step S1140). From step S115 onwards, similar operations are carried out to those in steps S3 to S10 of the print control operation according to the first example, which was described above with reference to FIG. 15, and hence the print jobs in the print queue are executed sequentially (steps S115, S116, S117, S118, S119, S120, S122, S123).

In the case of the sixth example, if the user loads paper in the manual paper supply unit 4 during the processing of a print job relating to a manual print request, then when this paper is detected by the manual paper size determination unit 21 (YES at step S120), the print job management unit 19 acquires the corresponding print data from the computer terminal of the user who issued the manual print request, via the computer interface unit 1400, and it stores this print data in the image memory unit 16 (step S121). A corresponding manual print operation is then carried out in accordance with this data (step S117).

In this way, according to the sixth example, when a manual print request has been issued, the corresponding print image data is not stored in the image forming apparatus until paper is loaded in the manual paper supply unit 4. Therefore, it is possible to use the memory of the image forming apparatus in an efficient manner.

The concept of the sixth example can also be applied similarly to the print control operations for an image forming apparatus according to the other examples described above.

Figure 16A:
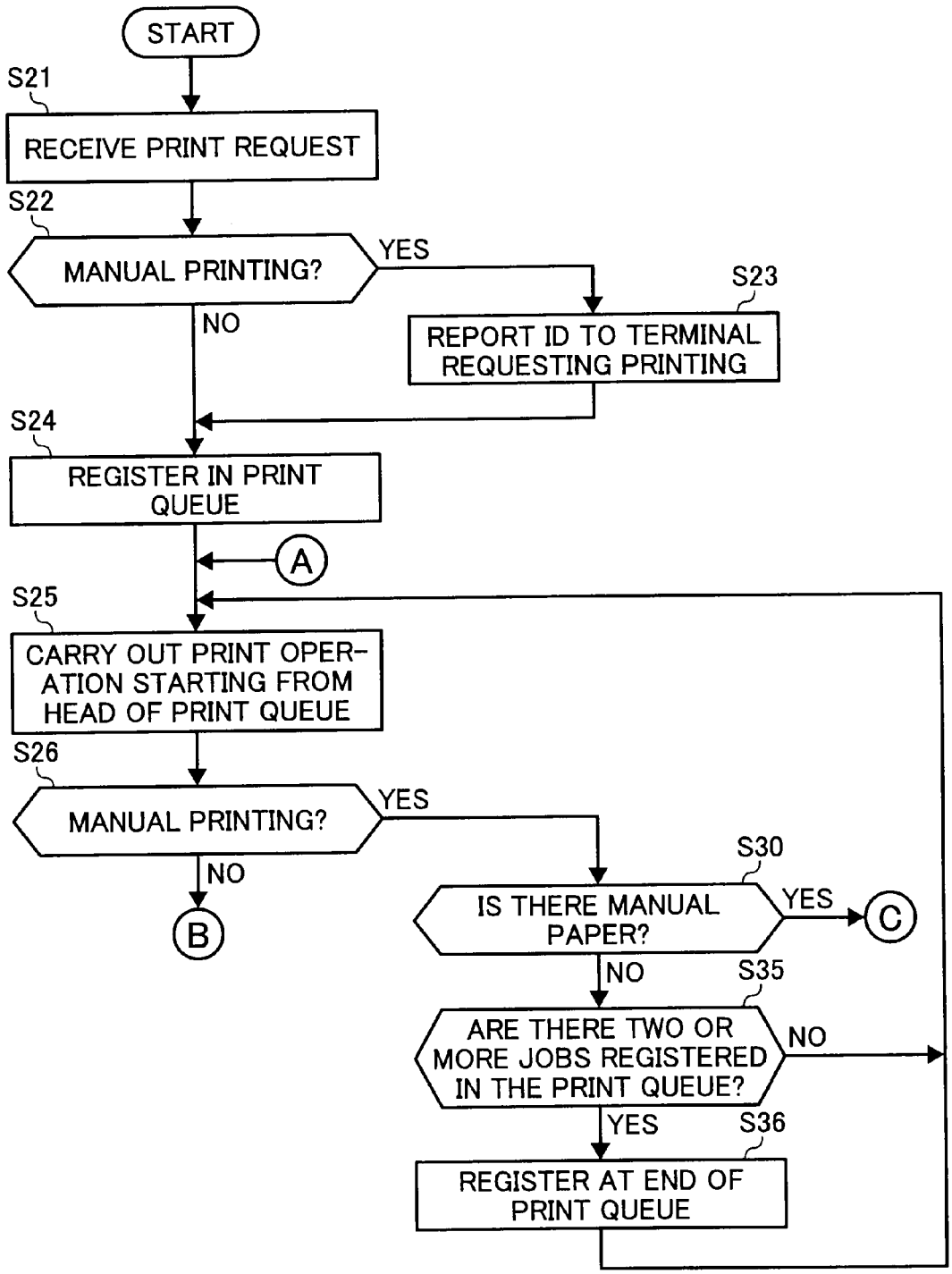
FIGS. 16A and 16B are flowcharts showing the sequence of a second example of processing (a print control operation) relating to a print request in the image forming apparatus.
Figure 16B:
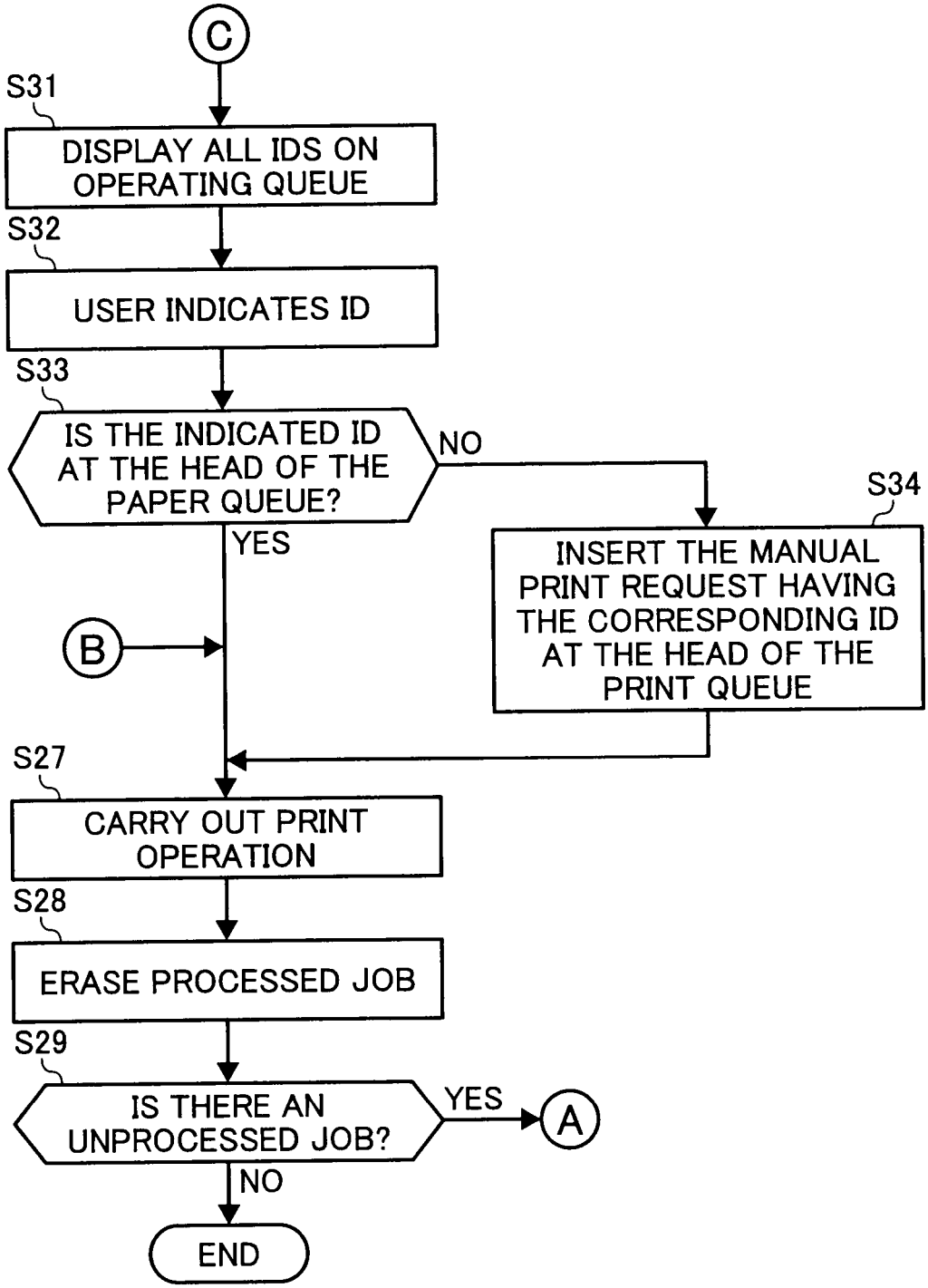

In other words, in the case of the second example shown in FIGS. 16A and 16B, if at step S22, the corresponding print request does not relate to manual printing (NO), then at that point, the corresponding print image data is acquired from the computer terminal of the user who issued the request and it is stored in the image memory 16, as in step S114 described above. However, if it is a manual print request (YES at step S22), then at that point, the corresponding print image data is not acquired from the computer terminal of the user who issued the request and it is not stored in the image memory 16. Thereupon, at step S30, when the loading of paper into the manual paper supply unit 4 is detected, then immediately before the corresponding print operation is carried out at step S27, the print image data relating to the manual print request is acquired from the computer terminal of the user who issued the request and it is stored in the image memory 16. A print operation can then be carried out in accordance with this print image data.

Figure 17A:
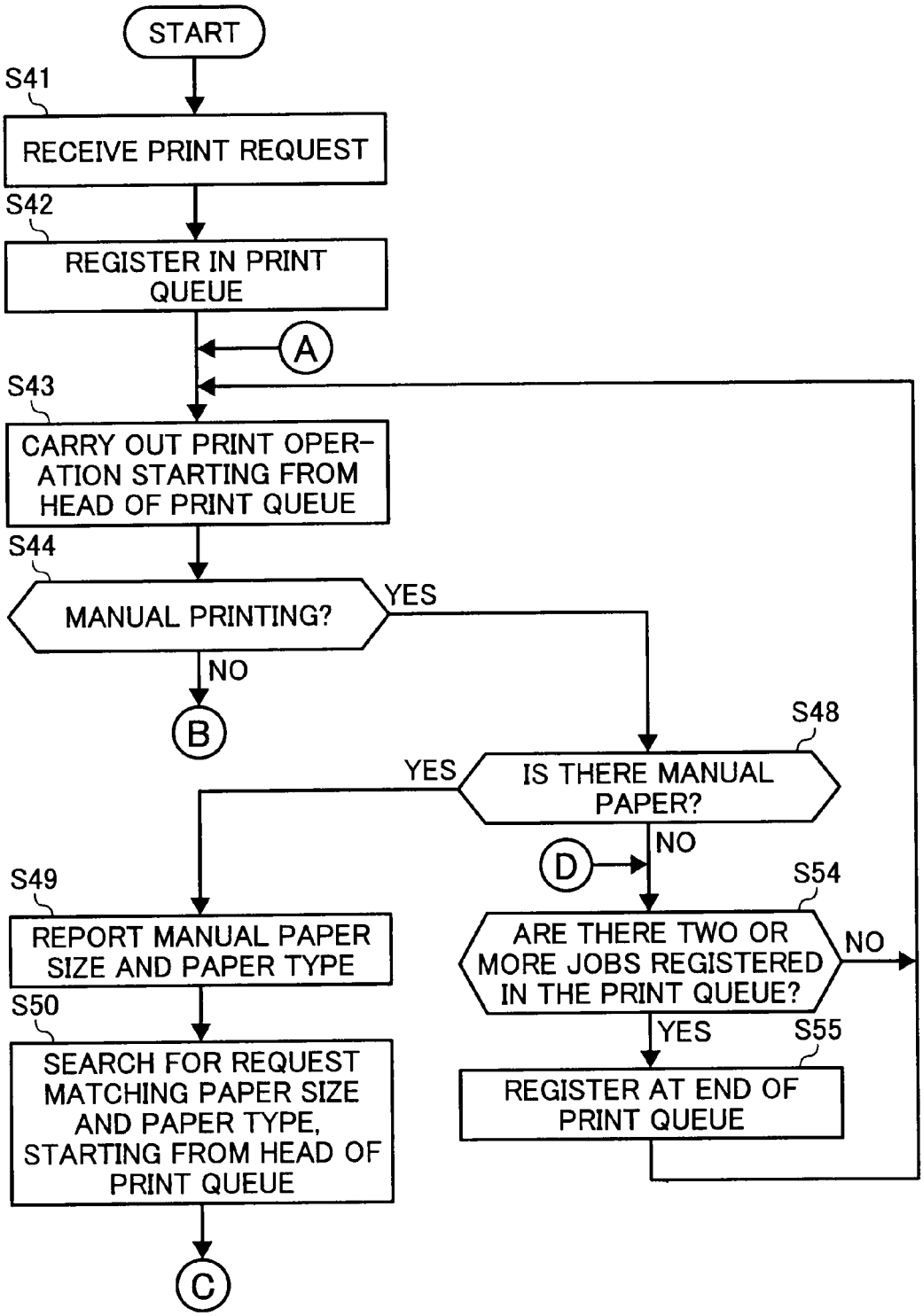
FIGS. 17A and 17B are flowcharts showing the sequence of a third example of processing (a print control operation) relating to a print request in the image forming apparatus.
Figure 17B:
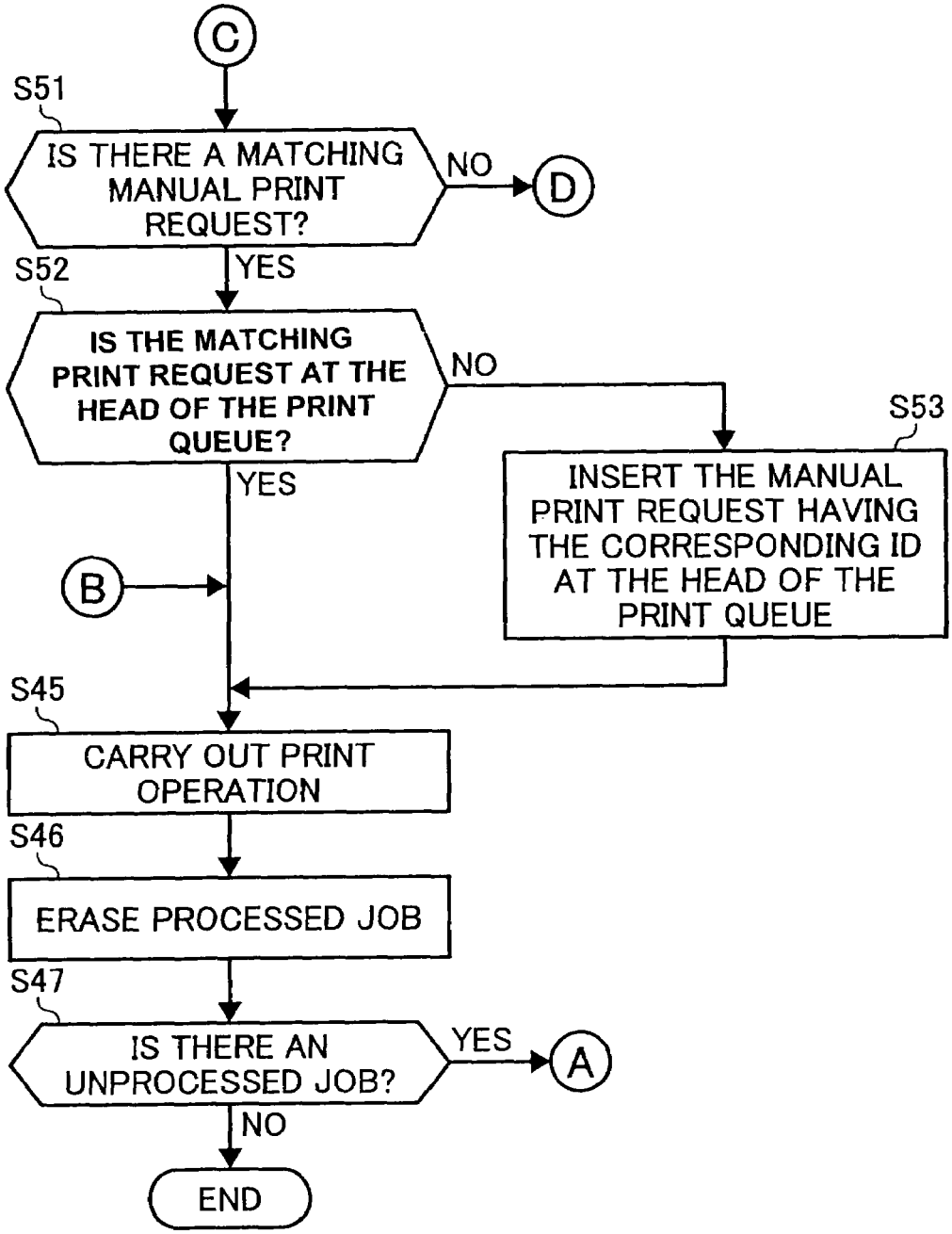

Furthermore, in the case of the third example described in FIGS. 17A and 17B, at step S41, at the point that a print request has been received from a user's computer terminal, it is judged whether or not that print request relates to manual printing, on the basis of the information relating to the paper supply tray contained in the print request, as in step S113. If, as a result of this, the corresponding print request does not relate to manual printing (NO), then at that point, corresponding print data is acquired from the computer terminal of the user who issued the request and it is stored in the image memory 16, as in step 1140 described above.

If, on the other hand, the print request does relate to manual printing (YES), then at that point, the corresponding print data is not acquired from the computer terminal of the user who issued the print request and it is not stored in the image memory 16.

When the loading of paper into the manual paper supply unit 4 is subsequently detected at step S48, then at step S45, immediately before the corresponding print operation is executed, the print data relating to that manual print request is acquired from the computer terminal of the user who issued the request and it is stored in the image memory 16. A print operation can then be carried out in accordance with this data.

Figure 18A:
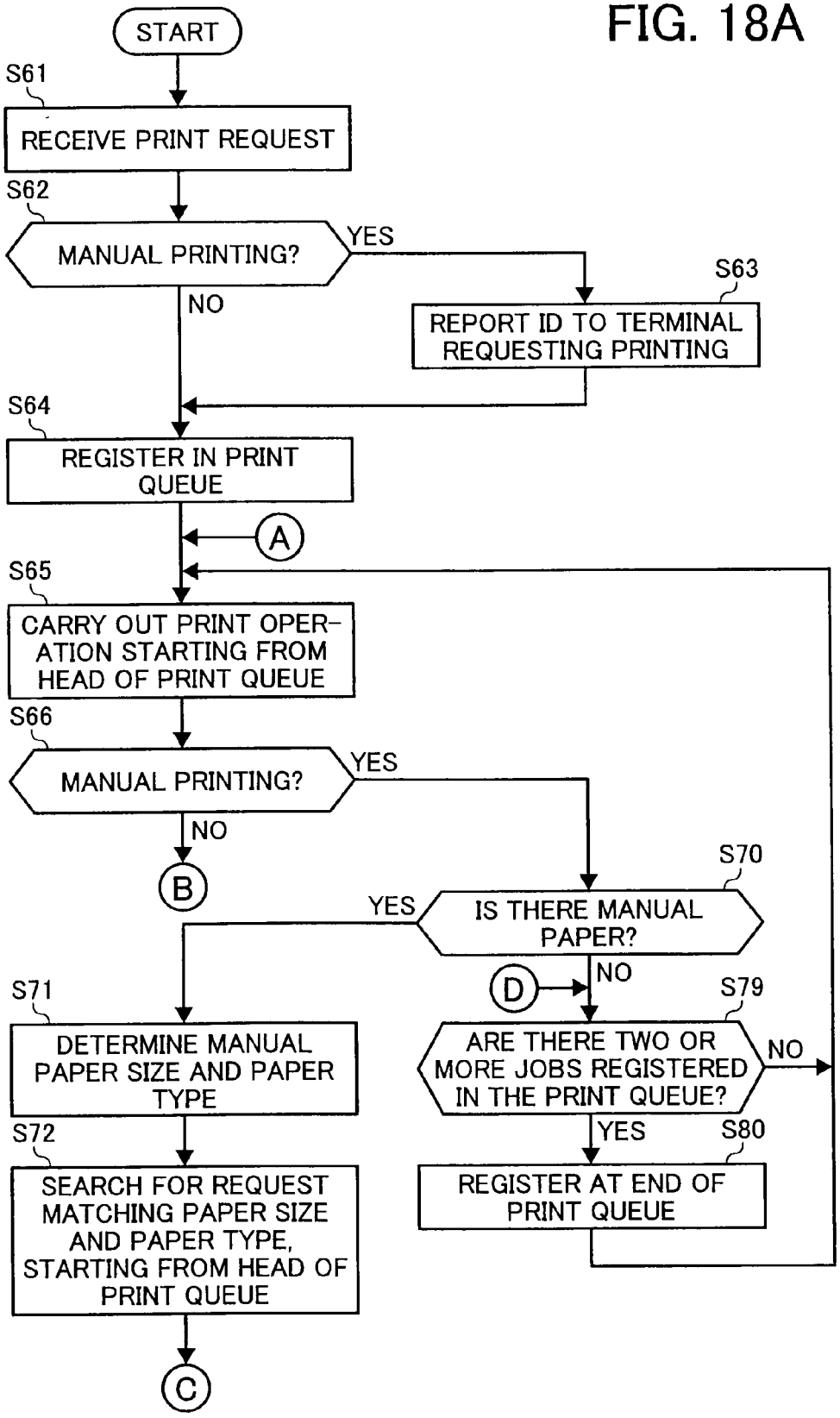
FIGS. 18A and 18B are flowcharts showing the sequence of a fourth example of processing (a print control operation) relating to a print request in the image forming apparatus.
Figure 18B:
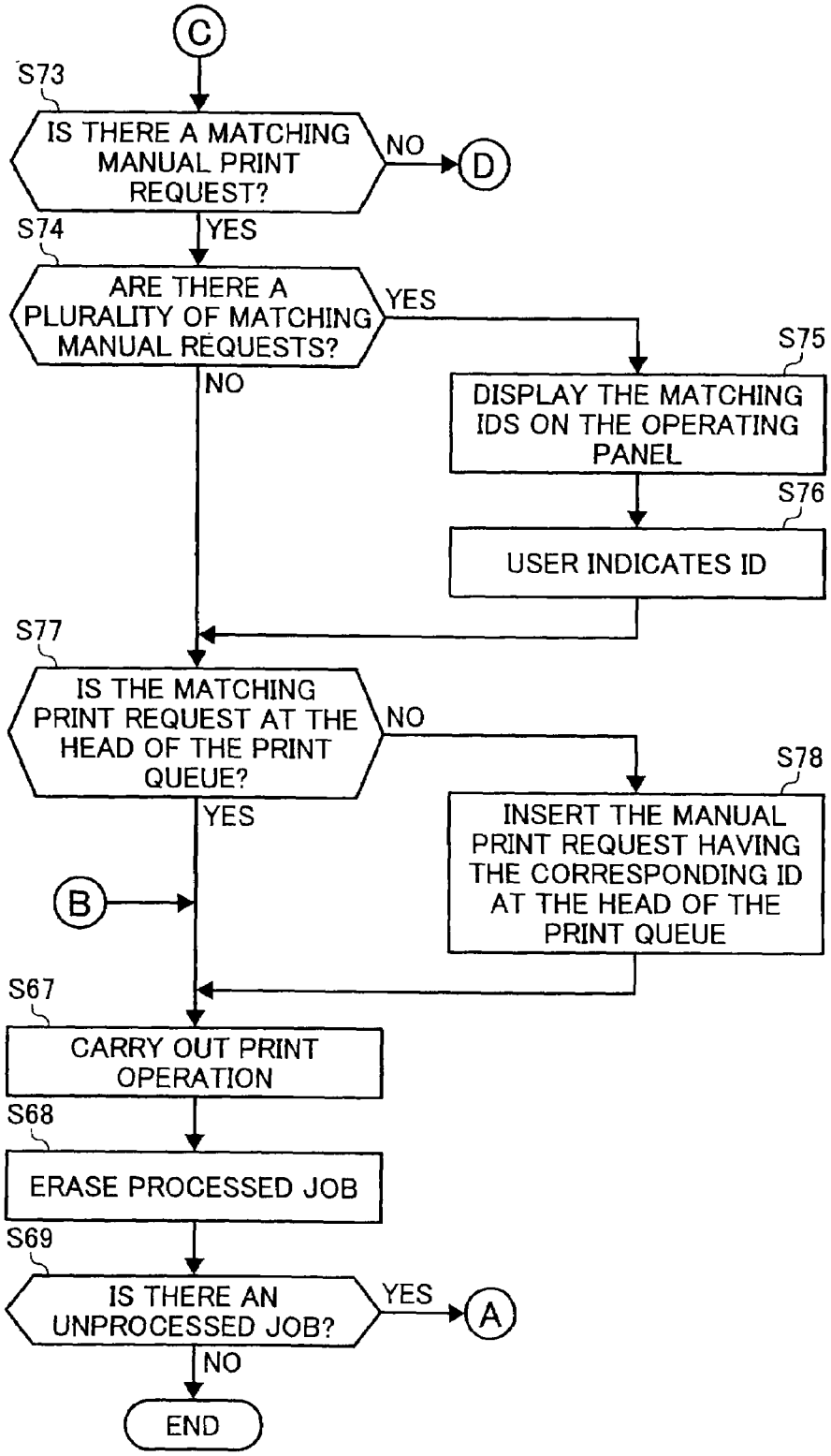

In the case of the fourth example described in FIGS. 18A to 18C, if the corresponding print request does not relate to manual printing at step S62 (NO), then at that point, the corresponding print data is acquired from the computer terminal of the user who issued the request and it is stored in the image memory 16, as in step S1140 described above. However, if it is a manual print request (YES at step S62), then at that point the corresponding print data is not acquired from the computer terminal of the user who issued the request and it is not stored in the image memory 16. When the loading of paper into the manual paper supply unit 4 is subsequently detected at step S70, then at step S67, immediately before carrying out the corresponding print operation, the print data relating to that manual print request is acquired from the computer terminal of the user who issued the request and it is stored in the image memory 16. A print operation can then be carried out in accordance with this data.

In the case of the fifth example shown in FIGS. 19A and 19B, if at step S92 the corresponding print request does not relate to manual printing (NO), then at that point, the corresponding print data is acquired from the computer terminal of the user who issued the request and it is stored in the image memory 16, as in step 1140 described above. However, if it is a manual print request (YES at step S92), then at that point, the corresponding print data is not acquired from the computer terminal of the user who issued the request and it is not stored in the image memory 16. When the loading of paper into the manual paper supply unit 4 is subsequently detected at step S1010, then at step S97, immediately before carrying out the corresponding print operation, the print data relating to that manual print request is acquired from the computer terminal of the user who issued the request and it is stored in the image memory 16. A print operation can then be carried out in accordance with this data.

Figure 21A:
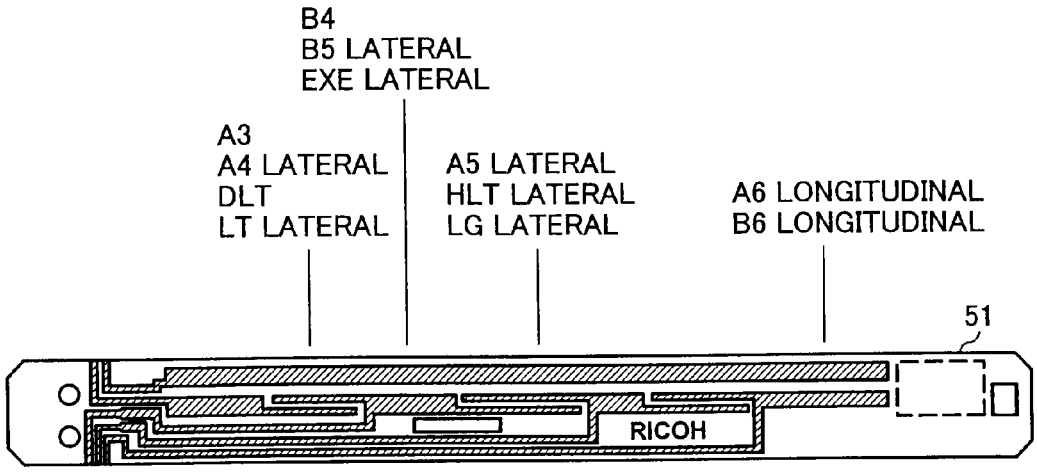
FIGS. 21A and 21B are diagrams for describing one example of a paper size determination method in the image forming apparatus.
Figure 21B:
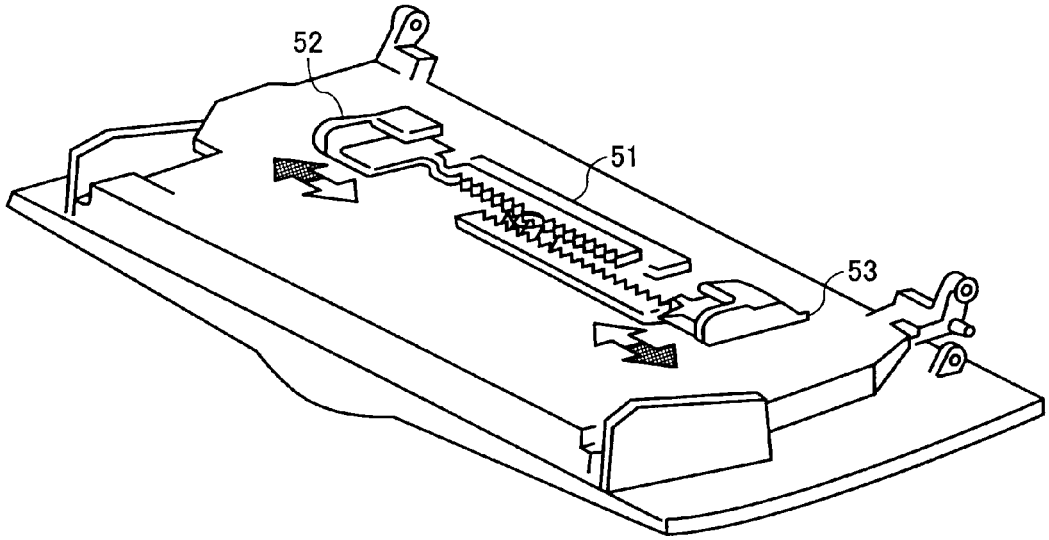

FIGS. 21A and 21B are diagrams for illustrating a paper size determination method which can be applied to the manual paper determination unit 2100 shown in FIG. 14.

FIG. 21B is an oblique diagram showing a composition for determining the paper size. FIG. 21B shows a paper tray provided in the manual paper supply unit 4. The paper tray is provided with right and left-side fences 52 and 53 which sandwich the paper from the right and left-hand sides when the paper is loaded in the tray, in order that the paper is loaded in the prescribed position, and a paper size determination base plate 51.

The paper size determination base plate 5 has conductive patterns as shown in FIG. 21A, and the conductive patterns are shorted out, at a corresponding position, by an electrode plate which moves in conjunction with the left side fence 52 of the left and right side fences 52 and 53. Therefore, by extracting a signal from the conductive patterns, it is possible to determine the position of the side fence. Consequently, it is possible to determine the width of the paper loaded in the paper supply tray, which is sandwiched between the side fences. In other words, if A6 portrait (vertically oriented A6 paper) or B6 portrait (vertically oriented B6 paper), which have a small paper width, are set, then the left and right-hand side fences 52 and 53 are moved in the direction of the center in FIG. 21B and set in position. Therefore, the left side fence 52 becomes positioned further toward the right-hand side, and accordingly, the electrode which moves in conjunction with the side fence also becomes positioned toward the right-hand side. Consequently, in FIG. 21A, the patterns in the right-end portion of the paper size determination base plate 51 are shorted out.

If, on the other hand, wider paper settings, such as A3 or A4 landscape, are used, then the left and right side fences 52 and 53 will be set to widely separated positions on the left and right-hand sides, respectively, and therefore, the left side fence 52 will be positioned towards the left-hand side, and the patterns on the left-end portion in FIG. 21A will be shorted out.

In this way, the patterns which are shorted on the paper size determination base plate 51 vary depending on the width of the paper loaded on the paper supply tray, and this can be extracted in the form of an electrical signal.

Furthermore, it is also possible to detect that paper has been loaded, by the fact that any one of the patterns on the paper size determination substrate 51 has been shorted.

Figures 22, 23A, 23B:
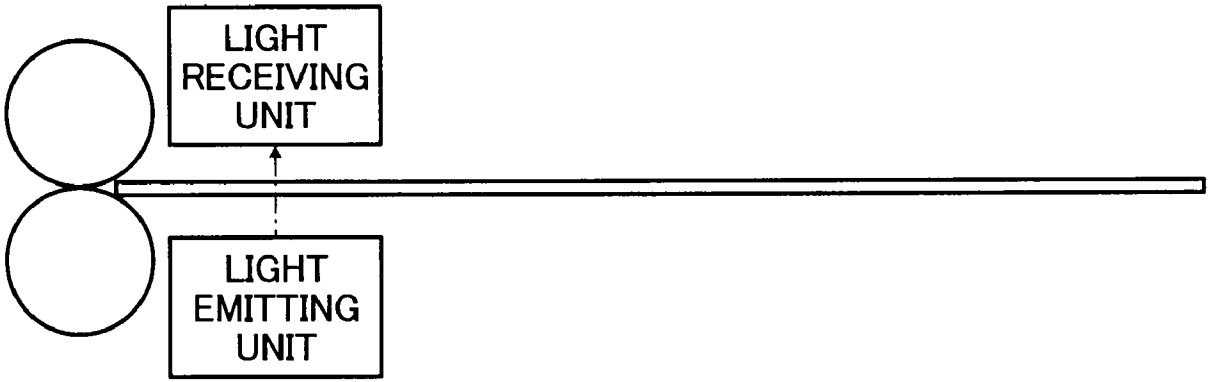
FIG. 22 is a diagram for describing one example of a paper type determination method in the image forming apparatus.
FIGS. 23A and 23B are diagrams showing one example of a mode of displaying print job IDs in the image forming apparatus.

FIG. 22 is a diagram for describing one example of a paper type determination method which can be applied to the manual paper type determination unit 20 shown in FIG. 14.

FIG. 22 shows a side view of a conveyance roller section for conveying paper, at an output section of a manual paper supply unit 4 in the plotter unit shown in FIG. 12. As shown in FIG. 22, a light-emitting unit and a light-receiving unit are provided respectively to the upper and lower sides of the paper supplied from the manual paper supply unit 4, and the transmissivity of the paper with respect to the light emitted from the light-emitting unit is measured by means of the light intensity value determined by the light-receiving unit. Thereupon, the measured value is compared with standard transmissivity values of respective paper types which have been measured previously, and the paper is judged to be the paper type corresponding to the standard transmissivity value which is nearest in this comparison.

FIGS. 23A and 23B are diagrams showing examples of modes of displaying an ID, which is identification information assigned to a print request relating to manual printing, as displayed on the operating section 17, in the print control operation for an image forming apparatus according to the second example described above and shown in FIGS. 16A and 16B and the fourth example shown in FIGS. 18A and 18B, respectively.

FIG. 23A shows the contents displayed on the display device of the operating section 17 initially, at step S31 in FIGS. 16A and 16B or at step S75 in FIGS. 18A and 18B. In this case, a print job corresponding to the displayed ID=6 is executed by means of the user pressing down the OK button on the operating section 17, for example.

On the other hand, if the "down" button is pressed on the operating section 17, then the display changes to the contents shown in FIG. 23B. If the user presses the OK button on the operating section 17 at this stage, for example, then the print job corresponding to the displayed ID=10 is executed.

In this way, in the case of the examples in FIGS. 23A and 23B, the displayed ID changes sequentially, each time the down button is pressed.

As described above, according to this second embodiment, even when an image formation request for a prescribed image recording medium is received, processing relating to other image formation requests is permitted until it is detected that the prescribed image recording medium has been loaded. Therefore, decline in the processing efficiency of the image forming apparatus is prevented.

Various modifications will becomes possible for those skilled in the art after receiving the teachings of the present disclosure without departing from the scope thereof.

What is claimed is:

1. An image forming apparatus which forms an image on an image recording medium in accordance with an image formation request, comprising:

an image recording medium detection unit which detects that an image recording medium has been loaded into the image forming apparatus for a manual print job; and a processing permitting unit which, when an image formation request relating to the manual print job is received and the image recording medium detection unit does not detect that an image recording medium has been loaded into the image forming apparatus for the manual print job, moves the image formation request relating to the manual print job to the end of a printing queue, and permits processing in respect of another image formation request, until the image recording medium detection unit detects that the prescribed image recording medium has been loaded.

2. The image forming apparatus as claimed in claim 1, wherein the processing permitting unit comprises a delaying unit configured to delay a processing sequence relating to the image formation request relating to the manual print job for image formation onto the image recording medium.

3. The image forming apparatus as claimed in claim 1, further comprising:

a storing unit configured to store image formation data relating to a corresponding image formation request in a prescribed storage unit, when detected by the image recording medium detection unit that the image recording medium has been loaded.

4. The image forming apparatus as claimed in claim 1, further comprising:

a sending unit which sends back to a user corresponding identification information, when an image formation request relating to the manual print job is received;

a display unit which displays the corresponding identification information when loading of the image recording medium has been detected; and an image formation unit which carries out image formation onto the image recording medium, upon designation of the corresponding identification information by the user.

5. The image forming apparatus as claimed in claim 1, further comprising:

an image recording medium characteristics determination unit which determines prescribed characteristics of an image recording medium that has been loaded; and an image formation processing unit which carries out image formation processing for an image formation request which matches the characteristics of the image recording medium as determined by the image recording medium characteristics determination unit.

6. The image forming apparatus as claimed in claim 5, further comprising:

a display unit which displays corresponding identification information, in cases where a plurality of image formation requests which match the characteristics of the image recording medium determined by the image recording medium characteristics determination unit are present; and an image formation processing unit which carries out image formation processing onto the image recording medium, upon designation of the corresponding identification information by a user.

7. The image forming apparatus as claimed in claim 1, further comprising:

a preference unit which, when the image formation request relating to the manual print job is received, gives preference to execution of that image formation request, over processing in respect of other image formation requests, and wherein the processing permitting unit, even after an image formation request relating to the manual print job has been given preference, permits processing for the other image formation requests, until detected by the image recording medium detection unit that the image recording medium for the manual print job has been loaded.

8. The image forming apparatus as claimed in claim 1, wherein the image formation request relating to the manual print job is based on a presumption that a corresponding image recording medium is loaded by a user after sending the image formation request, and the another image formation request is based on a presumption that image formation is carried out onto an image recording medium that is previously loaded into the image forming apparatus.

9. A method for controlling an image forming apparatus which forms an image on an image recording medium in accordance with an image formation request, comprising:

detecting that an image recording medium has been loaded into the image forming apparatus for a manual print job; and when an image formation request relating to the manual print job is received and the detecting does not detect that an image recording medium has been loaded into the image forming apparatus for the manual print job, moving the image formation request relating to the manual print job to the end of a printing queue, and permitting processing for another image formation request, until the detecting detects that the image recording medium has been loaded.

10. The method as claimed in claim 9, wherein the permitting processing further comprises delaying a processing sequence relating to the image formation request relating to the manual print job for image formation onto the image recording medium.

11. The method as claimed in claim 9, further comprising:

storing image formation data relating to a corresponding image formation request in a prescribed storage unit, when detecting that the image recording medium has been loaded.

12. The method as claimed in claim 9, further comprising:

sending back to a user corresponding identification information, when an image formation request relating to the manual print job is received;

displaying the corresponding identification information when loading of the image recording medium has been detected; and carrying out image formation onto the image recording medium, upon designation of the corresponding identification information by the user.

13. The method as claimed in claim 9, further comprising:

determining prescribed characteristics of an image recording medium that has been loaded; and carrying out image formation processing for an image formation request which matches the determined characteristics of the image recording medium.

14. The method as claimed in claim 13, further comprising:

displaying corresponding identification information, in cases where a plurality of image formation requests which match the determined characteristics of the image recording medium are present; and carrying out image formation processing onto the image recording medium, upon designation of the corresponding identification information by a user.

15. The method as claimed in claim 9, further comprising:

when the image formation request relating to the manual print job is received, giving preference to execution of that image formation request, over processing in respect of other image formation requests; and even after an image formation request relating to manual print job has been given preference, permitting processing for the other image formation requests, until detecting that the prescribed image recording medium has been loaded.

16. The method as claimed in claim 9, wherein the image formation request relating to the manual print job is based on a presumption that a corresponding image recording medium is loaded by a user after sending the image formation request, and the another image formation request is based on a presumption that image formation is carried out onto an image recording medium that is previously loaded into the image forming apparatus.

17. A computer readable storage medium encoded with computer executable instructions, which when executed by a computer controlling an image forming apparatus which forms an image on a prescribed image recording medium in accordance with an image formation request, cause the computer to perform a method comprising:

detecting that an image recording medium has been loaded into the image forming apparatus for a manual print job; and when an image formation request relating to the manual print job is received and the detecting does not detect that an image recording medium has been loaded into the image forming apparatus for the manual print job, moving the image formation request relating to the manual print job to the end of a printing queue, and permitting processing for another image formation request, until the detecting detects that the image recording medium has been loaded.

18. The computer readable storage medium as claimed in claim 17, wherein the permitting processing further comprises delaying a processing sequence relating to the image formation request relating to the manual print job for image formation onto the image recording medium.

19. The computer readable storage medium as claimed in claim 17, the method further comprising:

storing image formation data relating to a corresponding image formation request in a prescribed storage unit, when detecting that the image recording medium has been loaded.

20. The computer readable storage medium as claimed in claim 17, the method further comprising:

sending back to a user corresponding identification information, when an image formation request relating to the manual print job is received;

displaying the corresponding identification information when loading of the image recording medium has been detected; and carrying out image formation onto the image recording medium, upon designation of the corresponding identification information by the user.

21. The computer readable storage medium as claimed in claim 17, the method further comprising:

determining prescribed characteristics of an image recording medium that has been loaded; and carrying out image formation processing for an image formation request which matches the determined characteristics of the image recording medium.

22. The computer readable storage medium as claimed in claim 21, the method further comprising displaying corresponding identification information, in cases where a plurality of image formation requests which match the determined characteristics of the image recording medium are present; and carrying out image formation processing onto the image recording medium, upon designation of the corresponding identification information by a user.

23. The computer readable storage medium as claimed in claim 17, the method further comprising:

when the image formation request relating to the manual print job is received, giving preference to execution of that image formation request, over processing in respect of other image formation requests; and even after an image formation request relating to manual print job has been given preference, permitting processing for the other image formation requests, until detecting that the prescribed image recording medium has been loaded.

24. The computer readable storage medium as claimed in claim 17, wherein the image formation request relating to the manual print job is based on a presumption that a corresponding image recording medium is loaded by a user after sending the image formation request, and the another image formation request is based on a presumption that image formation is carried out onto an image recording medium that is previously loaded into the image forming apparatus.

* * * * *